US011554597B2

(12) United States Patent
Shinagawa et al.

(10) Patent No.: US 11,554,597 B2
(45) Date of Patent: Jan. 17, 2023

(54) MEDIUM TRANSPORT DEVICE, RECORDING APPARATUS, AND CONTROL METHOD OF MEDIUM TRANSPORT DEVICE

(71) Applicant: SEIKO EPSON CORPORATION, Tokyo (JP)

(72) Inventors: Hiroki Shinagawa, Shiojiri (JP); Takayuki Tanaka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 9 days.

(21) Appl. No.: 17/305,604

(22) Filed: Jul. 12, 2021

(65) Prior Publication Data

US 2022/0009251 A1 Jan. 13, 2022

(30) Foreign Application Priority Data

Jul. 13, 2020 (JP) ..... JP2020-120148

(51) Int. Cl.
*B41J 15/04* (2006.01)
*B41J 13/10* (2006.01)
(Continued)

(52) U.S. Cl.
CPC ..... *B41J 15/04* (2013.01); *B41J 2/01* (2013.01); *B41J 13/0009* (2013.01); *B41J 13/103* (2013.01); *B65H 3/44* (2013.01); *B65H 5/06* (2013.01); *B65H 7/10* (2013.01); *B65H 7/18* (2013.01); *B65H 1/04* (2013.01); *B65H 2402/46* (2013.01); *B65H 2403/722* (2013.01); *B65H 2405/324* (2013.01); *B65H 2511/528* (2013.01); *B65H 2515/70* (2013.01); *B65H 2557/242* (2013.01); *B65H 2601/26* (2013.01); *B65H 2801/15* (2013.01)

(58) Field of Classification Search
CPC . B41J 15/04; B41J 2/01; B41J 13/0009; B41J 13/103; B65H 3/44; B65H 5/06; B65H 7/10; B65H 7/18; B65H 1/04; B65H 2402/46; B65H 2403/722; B65H 2405/324; B65H 2511/528; B65H 2515/70; B65H 2557/242; B65H 2601/26; B65H 2801/15
See application file for complete search history.

(56) References Cited

U.S. PATENT DOCUMENTS

2012/0281037 A1* 11/2012 Toya ..... B41J 15/04 347/16
2014/0239113 A1* 8/2014 Igarashi ..... B65H 23/185 242/420.5
2020/0101720 A1* 4/2020 Arakane ..... B41J 29/38

FOREIGN PATENT DOCUMENTS

JP H04-243761 A 8/1992

* cited by examiner

*Primary Examiner* — Henok D Legesse
(74) *Attorney, Agent, or Firm* — Workman Nydegger

(57) ABSTRACT

A medium transport device includes a feeding roller that feeds a recording medium, a transport roller that transports the recording medium toward a recording head, and a transport motor which is a common driving source for the feeding roller and the transport roller. The medium transport device includes a power transmission mechanism that transmits power of the transport motor to the feeding roller, and a control section that controls a current of the transport motor. The control section measures a current value flowing through the transport motor during driving as a measured current value, and adds a predetermined offset value to the measured current value to set a second limit value as a limit value of the current supplied to the transport motor.

17 Claims, 19 Drawing Sheets

(51) Int. Cl.

| | |
|---|---|
| ***B65H 5/06*** | (2006.01) |
| ***B65H 7/10*** | (2006.01) |
| ***B65H 7/18*** | (2006.01) |
| ***B65H 3/44*** | (2006.01) |
| ***B41J 13/00*** | (2006.01) |
| ***B41J 2/01*** | (2006.01) |
| *B65H 1/04* | (2006.01) |

MEDIUM TRANSPORT DEVICE, RECORDING APPARATUS, AND CONTROL METHOD OF MEDIUM TRANSPORT DEVICE

The present application is based on, and claims priority from JP Application Serial Number 2020-120148, filed Jul. 13, 2020, the disclosure of which is hereby incorporated by reference herein in its entirety.

BACKGROUND

1. Technical Field

The present disclosure relates to a medium transport device including: a transport roller that transports a medium; and a motor that drives the transport roller, a recording apparatus, and a control method of a medium transport device.

2. Related Art

For example, JP-A-4-243761 discloses a recording apparatus (image writing apparatus) including: a medium transport device having a transport roller that transports a recording medium, and a motor that drives the transport roller, in which recording is performed on the recording medium transported by the transport roller. The recording apparatus includes a determination section that compares a current value of the motor with a threshold value and determines a transport state of the recording medium. The determination section detects a jam based on the time when the current value of the motor exceeds the threshold value. When a jam occurs, the motor is forcibly stopped. For example, the threshold value used for jam detection is set to a value corresponding to an assumed maximum load (assumed maximum load) of the motor.

However, the threshold value (limit value) according to the assumed maximum load is set to a value corresponding to an average value of the maximum load that changes according to the cumulative usage amount of the recording apparatus, for example. At an initial stage of use start, such as immediately after unpacking the recording apparatus, the sliding resistance of components such as gears that configure a power transmission mechanism and the sliding resistance of the transport roller are relatively small, and the load applied to the motor is relatively small. Therefore, when an unintended load is applied to the power transmission mechanism that transmits the power of the motor, and there is a problem that there is a possibility that an excessive torque is applied to components such as gears that configure the power transmission mechanism even when the current value of the motor does not exceed the threshold value, and the components are damaged. As a medium transport device included in the recording apparatus, there is a medium transport device including a movable member other than the transport roller driven by the power of the motor. In this case, even when the movable member is driven, not limited to the transport roller, even when the current value of the motor does not exceed the threshold value when an unintended load is applied to the motor, excessive torque is applied to the components that configure the power transmission mechanism, and there is a problem that there is a possibility that the components such as gears that configure the power transmission mechanism are damaged.

SUMMARY

According to an aspect of the present disclosure, there is provided a medium transport device that transports a recording medium, including: a feeding roller that feeds the recording medium; a transport roller that transports the recording medium fed by the feeding roller; a motor which is a driving source for the feeding roller and/or the transport roller; a power transmission mechanism that transmits power of the motor to at least one of the feeding roller and the transport roller; and a control section that controls a current of the motor, in which the control section measures a current value during driving of the motor as a measured current value, and sets a limit value of a current supplied to the motor by adding a predetermined offset value to the measured current value.

According to another aspect of the present disclosure, there is provided a medium transport device that transports a recording medium, including: a feeding roller that feeds the recording medium; a transport roller that transports the recording medium fed by the feeding roller; a movable member other than the transport roller; a motor; a power transmission mechanism that transmits power of the motor to the movable member; and a control section that controls a current of the motor, in which the control section measures a current value during driving of the motor as a measured current value, and sets a limit value of a current supplied to the motor by adding a predetermined offset value to the measured current value.

According to still another aspect of the present disclosure, there is provided a recording apparatus including the medium transport device and a recording head that performs recording on the recording medium.

According to still another aspect of the present disclosure, there is provided a control method of a medium transport device including a feeding roller that feeds a recording medium, a transport roller that transports fed recording medium fed by the feeding roller, a motor which is a driving source for the feeding roller and/or the transport roller, a power transmission mechanism that transmits power of the motor to at least one of the feeding roller and the transport roller, and a control section that controls driving of the motor, the method including: measuring a current value during driving of the motor as a measured current value by the control section; and setting a limit value of a current supplied to the motor by adding a predetermined offset value to the measured current value by the control section.

According to still another aspect of the present disclosure, there is provided a control method of a medium transport device including a feeding roller that feeds a recording medium, a transport roller that transports the recording medium fed by the feeding roller, a movable member other than the transport roller, a motor, a power transmission mechanism that transmits power of the motor to the movable member, and a control section that controls driving of the motor, the method including: measuring a current value during driving of the motor as a measured current value by the control section; and setting a limit value of a current supplied to the motor by adding a predetermined offset value to the measured current value by the control section.

DESCRIPTION OF EXEMPLARY EMBODIMENTS

Figure 1:
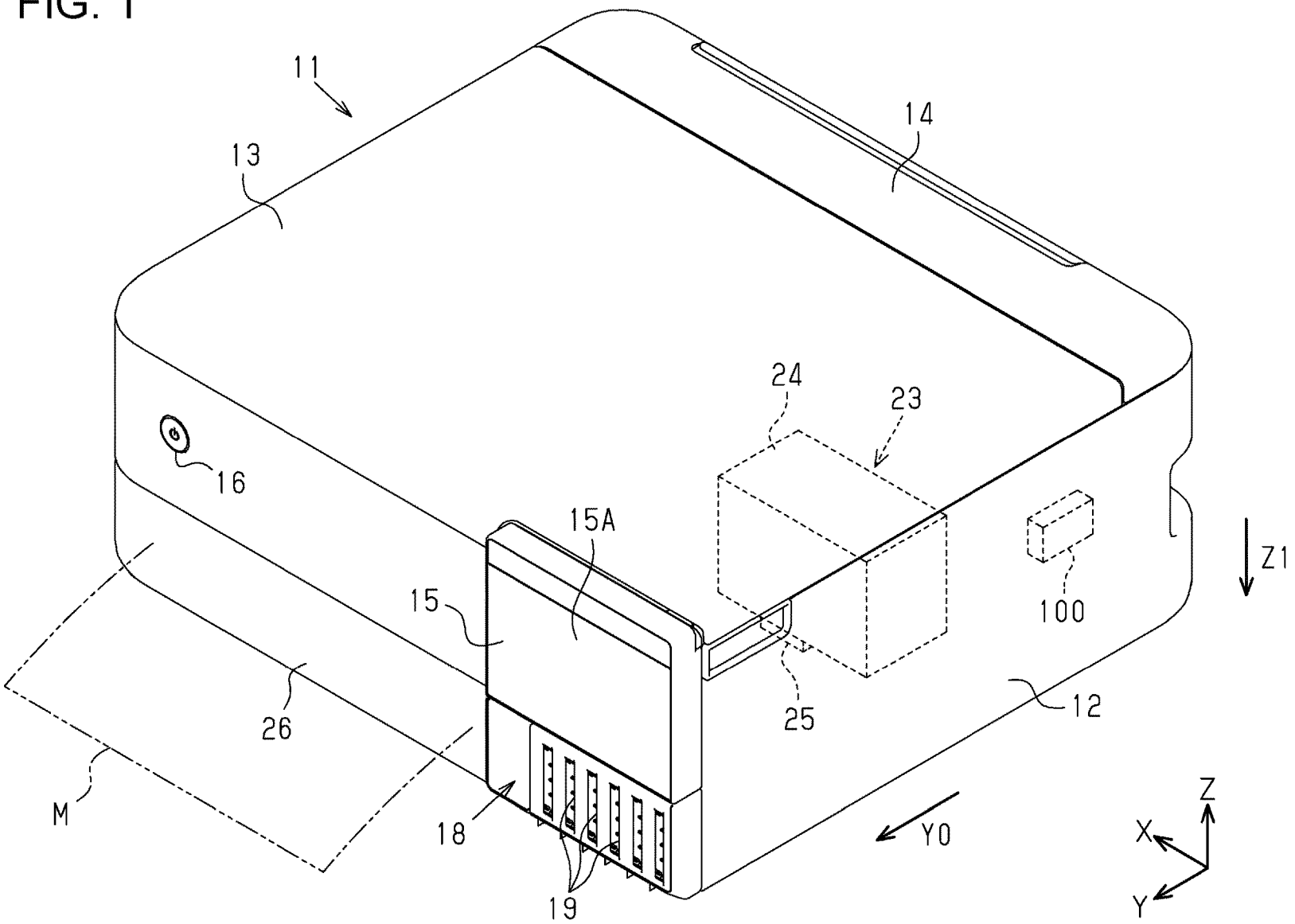
FIG. 1 is a perspective view of a recording apparatus according to an embodiment.

Hereinafter, an embodiment of a recording apparatus will be described with reference to the drawings. In FIG. 1, assuming that a recording apparatus 11 is mounted on a horizontal plane, three virtual axes orthogonal to each other are defined as an X axis, a Y axis, and a Z axis. The X axis is a virtual axis parallel to the scanning direction of the recording head, which will be described later, and the Y axis is a virtual axis parallel to the transport direction of a medium at the time of recording. The Z axis is a virtual axis parallel to a vertical direction Z1. The two directions which are parallel to the X axis and in which the recording head reciprocates are referred to as a scanning direction X. Since the scanning direction X is a direction parallel to the width direction of the recording medium to be transported, the scanning direction X is also referred to as a width direction X. One direction parallel to the Y axis indicates the transport direction of the medium at a recording position where the recording head performs recording on the recording medium. On the Y axis, the surface side of the recording apparatus 11 on which an operation panel 15 described later is arranged is referred to as front or front surface, and the side opposite to the front is referred to as rear or back surface. The transport path on which the medium M is transported is not parallel to the Y axis in the entire area, and a transport direction Y0 changes according to the position of a medium M on the transport path.

Configuration of Recording Apparatus

The recording apparatus 11 illustrated in FIG. 1 is a serial recording type ink jet printer. As illustrated in FIG. 1, the recording apparatus 11 includes an apparatus main body 12 and a cover 13 provided on the upper portion of the apparatus main body 12 so as to be openable and closable. The recording apparatus 11 has a substantially rectangular parallelepiped shape as a whole.

The recording apparatus 11 includes the operation panel 15 on the front surface. The operation panel 15 includes an operation section including operation buttons and the like that are operated when giving various instructions to the recording apparatus 11, and a display section (all of these are not illustrated) that displays various menus and the operating status of the recording apparatus 11. A power supply operation section 16 is provided on the front surface of the apparatus main body 12. It is also possible to configure the display section with a touch panel and configure the operation section with an operation function operated by the touch panel.

On the front right side of the apparatus main body 12, an accommodation section 18 for accommodating at least one (six in this embodiment) liquid supply source 17 (refer to FIG. 2) is provided. The accommodation section 18 has at least one (six in this embodiment) window section 19 corresponding to each liquid supply source 17. The window section 19 is made of transparent or translucent resin, and the user can visually recognize the liquid level of the liquid accommodated in the liquid supply source 17 through the window section 19 from the outside.

On the rear upper side of the recording apparatus 11, a feeding cover 14 is provided to be openable and closable. The feeding cover 14 is opened and closed by rotating around the rear end. A feeding section 20 is accommodated inside the feeding cover 14 which is at the closed position illustrated in FIG. 1 in the apparatus main body 12. The feeding section 20 feeds a medium M such as a paper sheet. The feeding section 20 has a feeding tray 22A (refer to FIG. 2) which is an example of a mounting section for mounting the medium M. The user mounts the recording medium M on the feeding tray 22A that is exposed when the feeding cover 14 is at the open position.

A recording section 23 for performing recording on the recording medium M (hereinafter, also simply referred to as "medium M") fed from the feeding tray 22A is accommodated in the apparatus main body 12. The recording section 23 is, for example, a serial recording type. The recording apparatus 11 is, for example, a serial printer. The serial recording type recording section 23 includes a carriage 24 capable of reciprocating in the scanning direction X, and a recording head 25 provided on the carriage 24. The surface of the recording head 25 facing the medium M transported along the transport path is a nozzle surface on which a plurality of nozzles (not illustrated) are open. The liquid supply source 17 and the recording section 23 are coupled to each other through a liquid supply tube 17A (refer to FIG. 5), and liquid is supplied from the liquid supply source 17 to the recording head 25 through the liquid supply tube 17A. The recording head 25 discharges the liquid from the plurality of nozzles toward the medium M while moving together with the carriage 24.

At the front lower portion of the recording apparatus 11, a discharge cover 26 is provided to be openable and closable.

The discharge cover 26 rotates around the lower end. At the back part of the discharge cover 26 at the closed position illustrated in FIG. 1 in the apparatus main body 12, a stacker (not illustrated) used for receiving the medium M after recording, and a cassette 27 (refer to FIG. 2) in which a plurality of media M before recording are mounted, is accommodated.

The recording apparatus 11 includes a control section 100 that performs various types of control. The control section 100 performs control of the carriage 24 and the recording head 25, the transport control of the medium M, the display control of the operation panel 15, the power supply control, and the like.

Next, a detailed configuration inside the recording apparatus 11 will be described with reference to FIGS. 2 and 3.

Figure 2:
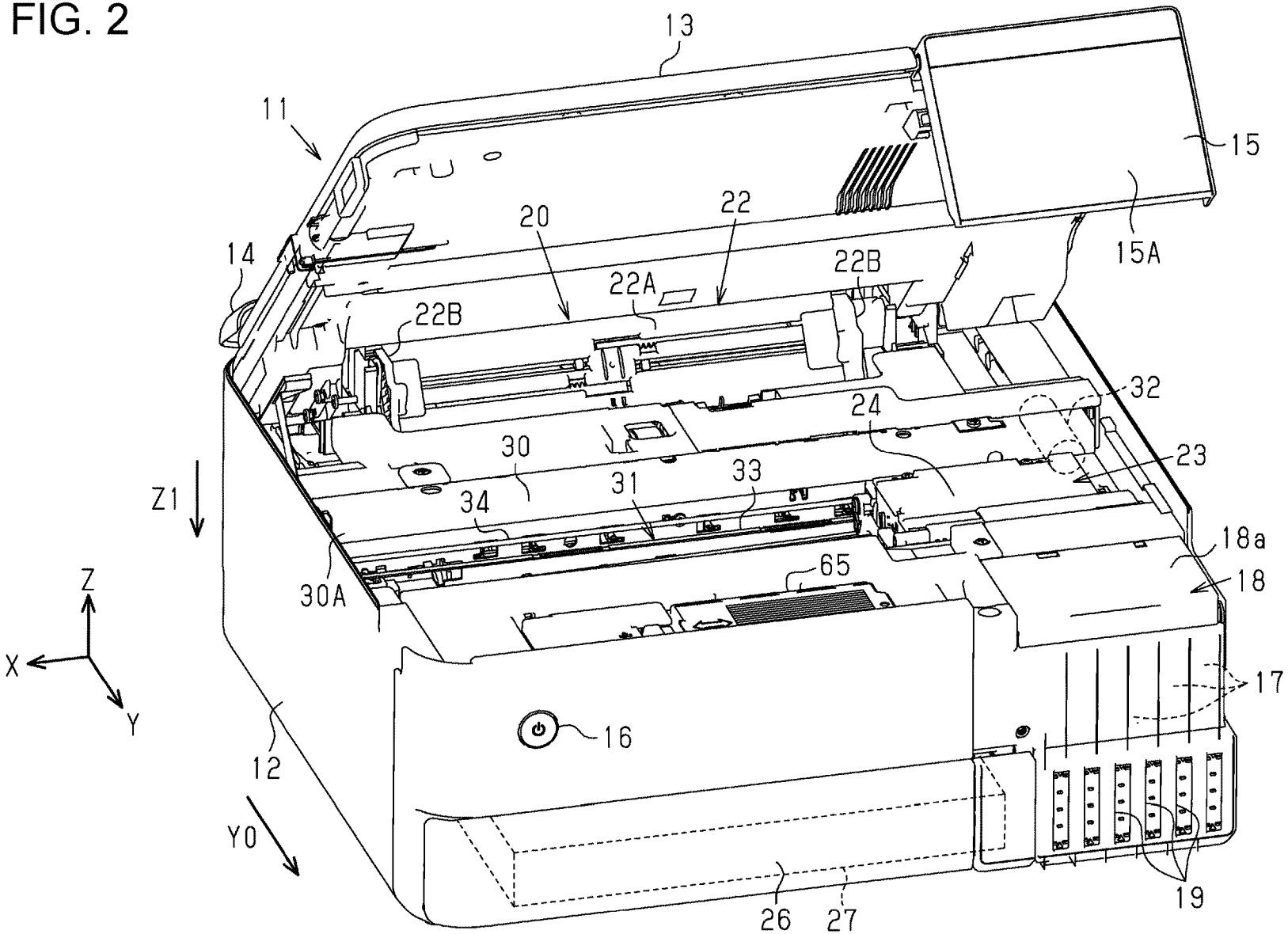
FIG. 2 is a perspective view illustrating the recording apparatus in a state where a cover is open.

As illustrated in FIG. 2, a main frame 30 extends in the width direction X in the apparatus main body 12. The main frame 30 has a pair of guide rails 30A (refer to also FIG. 3) that guide the carriage 24. The pair of guide rails 30A extend parallel to each other along the scanning direction. The carriage 24 is supported by the pair of guide rails 30A to be movable in the scanning direction X at two locations in the vertical direction Z1. The carriage 24 reciprocates in the scanning direction by being guided by the pair of guide rails 30A. A moving mechanism 31 for moving the carriage 24 in the scanning direction X is provided between the main frame 30 and the carriage 24. The moving mechanism 31 is, for example, a belt drive type, and includes a carriage motor 32 which is a driving source of the carriage 24, and an endless timing belt 33 stretched along the scanning direction X. The carriage 24 is fixed to a part of the timing belt 33. When the carriage motor 32 rotates forwardly and reversely, the carriage 24 reciprocates in the scanning direction X via the timing belt 33. The moving mechanism 31 may be a known linear drive type other than the belt drive type.

The main frame 30 is provided with a linear encoder 34 extending along the scanning direction. The linear encoder 34 includes a linear scale extending along the scanning direction X and an optical sensor (not illustrated) attached to the carriage 24. The optical sensor detects the translucent scale of the linear scale and outputs a detection pulse signal including the number of pulses proportional to the movement amount of the carriage 24.

The accommodation section 18 is provided with a supply cover 18*a* that opens and closes the upper portion thereof. In the example, the liquid supply source 17 is a tank in which the liquid is accommodated. When there is the liquid supply source 17 of which a remaining amount is small through the window section 19, the user opens the cover 13 and the supply cover 18*a*, and pours the liquid from the liquid bottle into the pours (not illustrated) of the liquid supply source 17. The liquid supply source 17 is not limited to a liquid replenishment type tank in which the user replenishes the liquid from the liquid bottle, and may be a liquid pack (for example, an ink pack) or a liquid cartridge (for example, an ink cartridge) in which the liquid is accommodated. The liquid supply source 17 is an off-carriage type provided on the apparatus main body 12, but may be an on-carriage type mounted on the carriage 24.

Figure 3:
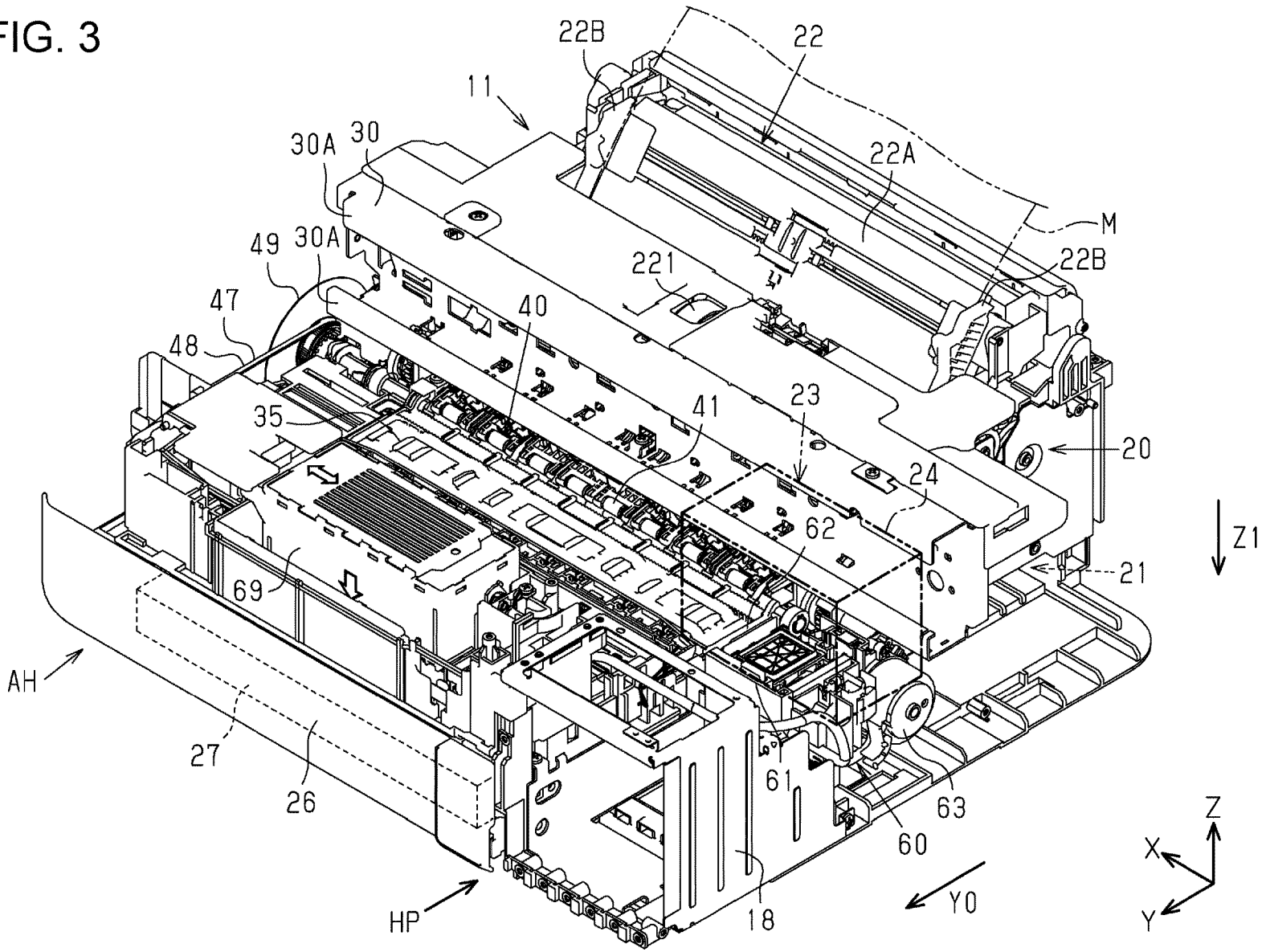
FIG. 3 is a perspective view illustrating the recording apparatus in a state where a housing is removed.

As illustrated in FIG. 3, the feeding section 20 includes: a first feeding section 21 for feeding the medium M loaded on the cassette 27; and a second feeding section 22 for feeding the medium M mounted on the feeding tray 22A. The cassette 27 can be inserted and removed in a direction parallel to the Y axis to and from the recessed insertion/attachment section which is open on the front surface where the cover 26 of the apparatus main body 12 is open. The user pulls out the cassette 27 from the apparatus main body 12 in the transport direction Y to set the medium M or replace the medium M. The user pushes the cassette 27 in which the medium M is set into the insertion/attachment section.

The feeding tray 22A is provided with a pair of edge guides 22B. The medium M mounted on the feeding tray 22A is positioned in the width direction X by being held between the pair of edge guides 22B. The feeding section 20 feeds the medium M mounted on the feeding tray 22A in a transport direction Y0 along the transport path. The recording apparatus 11 of the embodiment includes the cassette 27 and the feeding tray 22A as a plurality of mounting sections on which the medium M is mounted. The recording apparatus 11 includes a plurality of feeding sections 21 and 22 for feeding the media M mounted on the plurality of mounting sections, respectively. As a mounting section, a manual feed tray used by the user on which the media M are mounted one by one may be provided, or one or a plurality of cassettes after the second one may be added to the lower stage of the cassette 27. The mounting section is at least two of the feeding tray 22A, the cassette 27, the manual feed tray, and the cassettes after the second cassette, and the feeding section includes at least two feeding sections that feed each of the media M mounted on at least two mounting sections.

Figure 4:
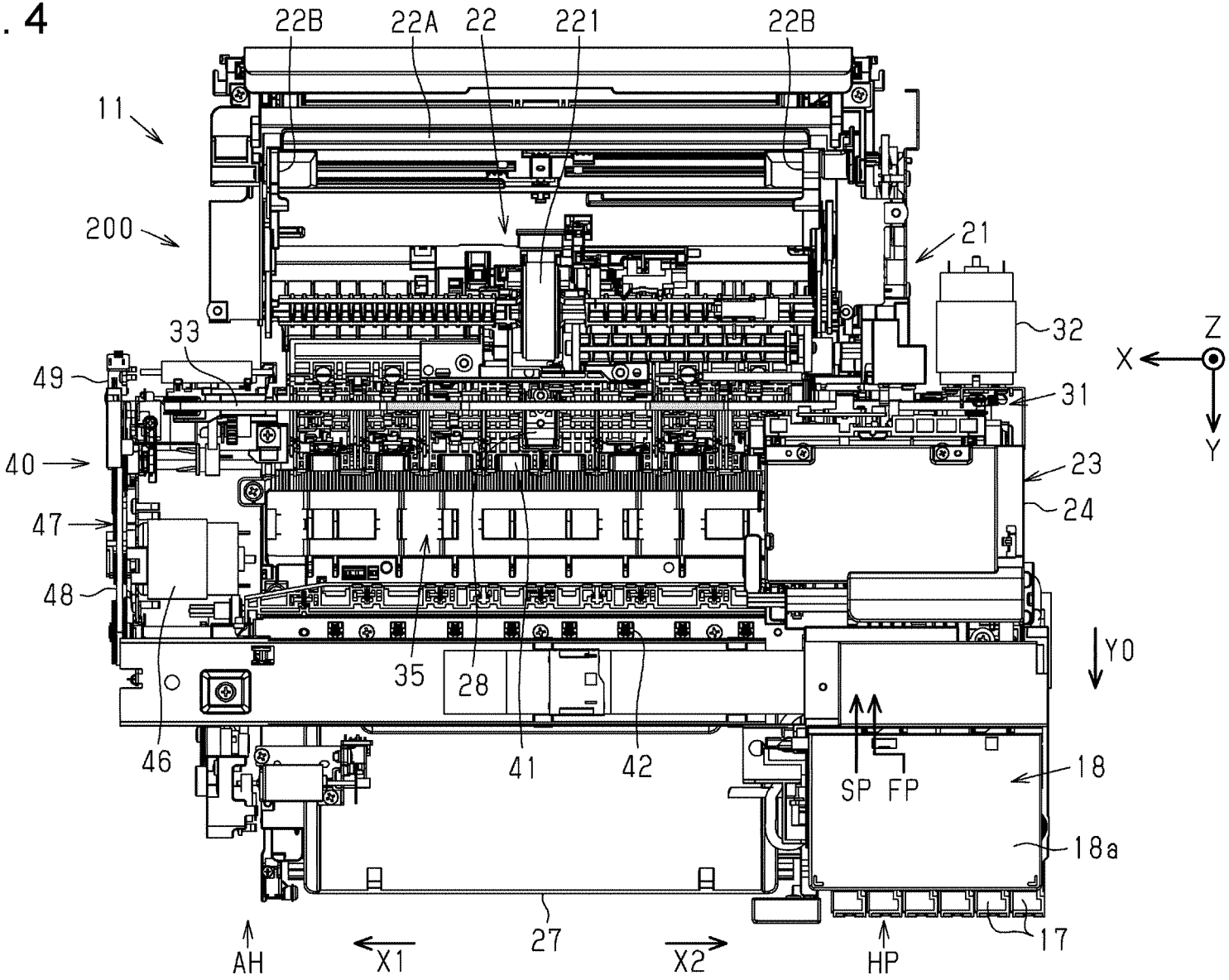
FIG. 4 is a plan view illustrating the recording apparatus in a state where the housing is removed.

As illustrated in FIGS. 3 and 4, the recording apparatus 11 includes a transport section 40 that transports the medium M fed from the feeding section 20 in a transport direction Y0. The transport section 40 includes a transport roller pair 41 and a discharge roller pair 42. The transport roller pair 41 and the discharge roller pair 42 are arranged in this order in the transport direction Y0.

The recording apparatus 11 includes a medium support member 35 that supports the medium M of the part on which recording is performed by the recording section 23. The medium support member 35 is a long member extending in the width direction X, and has a length capable of supporting the entire area in the width direction of the medium M having the maximum width. The recording section 23 performs recording on the part supported by the medium support member 35 on the transported medium M.

The recording apparatus 11 alternately repeats a recording operation in which the carriage 24 moves once and the recording head 25 performs recording one pass, and a transport operation in which the medium M is transported to the next recording position, and accordingly, characters or images are recorded on the medium M. The recording section 23 may use a line recording type. The line recording type recording section 23 includes the recording head 25 including a line head having a plurality of nozzles capable of simultaneously discharging liquid over the entire width of the medium having the maximum width. Since the liquid is discharged from the nozzle of the recording head 25 including the line head with the entire width of the medium M as the discharge target with respect to the medium M transported at a constant speed, high-speed recording of an image or the like is realized.

The carriage 24 illustrated by the two-dot chain line in FIG. 3 is positioned at a home position HP, which is a standby position when recording is not performed. At a position adjacent to the medium support member 35 in the width direction X, a maintenance device 60 for performing maintenance of the recording head 25 is disposed at a lower position facing the carriage 24 which is at the home position HP. The maintenance device 60 includes a cap 61 that caps the recording head 25 when the carriage 24 is at the home position HP, and a wiper 62 that wipes the nozzle surface of the recording head 25. By capping the recording head 25 with the cap 61, thickening or drying of liquid such as ink in the nozzle of the recording head 25 is suppressed. When the liquid in the nozzle becomes thick, there are bubbles in the liquid in the nozzle, or the nozzle is blocked by foreign matter such as paper dust, a discharge failure occurs in which the liquid cannot be discharged normally from the nozzle due to clogging of the nozzle.

The maintenance device 60 cleans the nozzle of the recording head 25 in order to eliminate or prevent this type of discharge failure. The maintenance device 60 includes a pump 63 that communicates with the cap 61. The maintenance device 60 drives the pump 63 under a capping state where the cap 61 comes into contact with the nozzle surface of the recording head 25 in a state of surrounding the nozzle. When the pump 63 is driven, the liquid is forcibly suctioned and discharged from the nozzle by the negative pressure introduced into the closed space between the nozzle surface and the cap 61. Foreign matter such as thickened liquid, bubbles, and paper dust is forcibly suctioned and discharged from the nozzle, and accordingly, the nozzle recovers from discharge failure.

The recording section 23 moves to the home position HP regularly or irregularly during the recording operation of performing recording on the medium M, and by performing idle discharge (also referred to as "flushing") for discharging droplets unrelated to the recording from all of the nozzles of the recording head 25 toward the cap 61, discharge failure during the recording is prevented. The liquid (waste liquid) discharged from the nozzle by cleaning and empty discharge is sent to a waste liquid tank 69 through a waste liquid tube by driving the pump 63.

Figure 5:
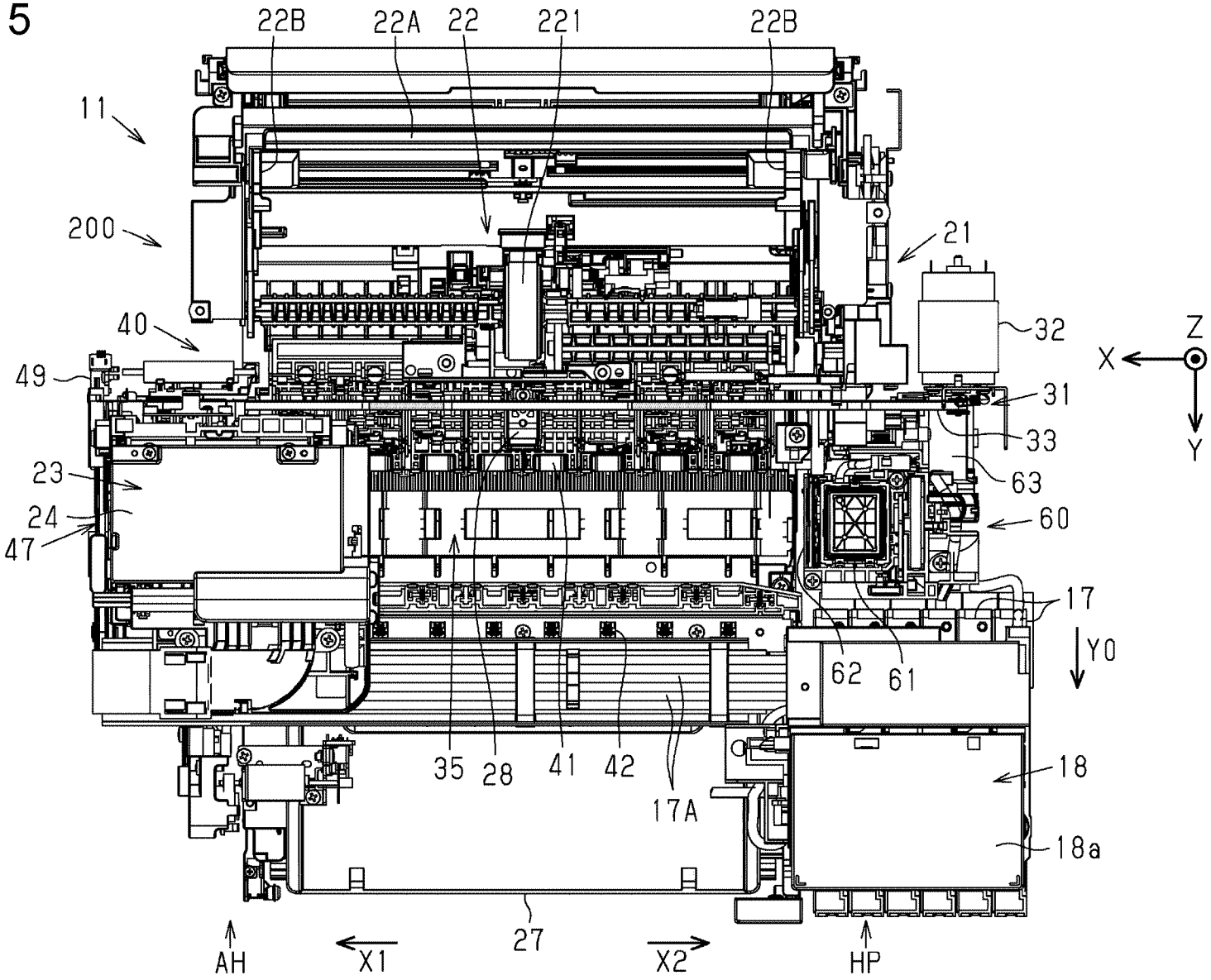
FIG. 5 is a plan view illustrating the recording apparatus in a state where the housing is removed.

As illustrated in FIGS. 4 and 5, the recording apparatus 11 includes the first feeding section 21 and the second feeding section 22 described above. The first feeding section 21 includes a pickup roller 211 (refer to FIG. 6), which is an example of the feeding roller that feeds one uppermost medium M from the medium group loaded on the cassette 27. The second feeding section 22 includes a feeding roller 221 that feeds the media M mounted on the feeding tray 22A one by one. The recording apparatus 11 includes the transport roller pair 41 and a discharge roller pair 42 described above. The recording apparatus 11 includes a transport motor 46 which is an example of the motor that is a driving source of the transport section 40.

As illustrated in FIGS. 4 and 5, the carriage 24 moves between the home position HP (FIG. 4) and the opposite-home position AH (FIG. 5) in the scanning direction X. The position of the carriage 24 illustrated in FIG. 4 is the home position HP, which is a standby position during the non-recording in which recording is not performed on the medium M.

Figure 6:
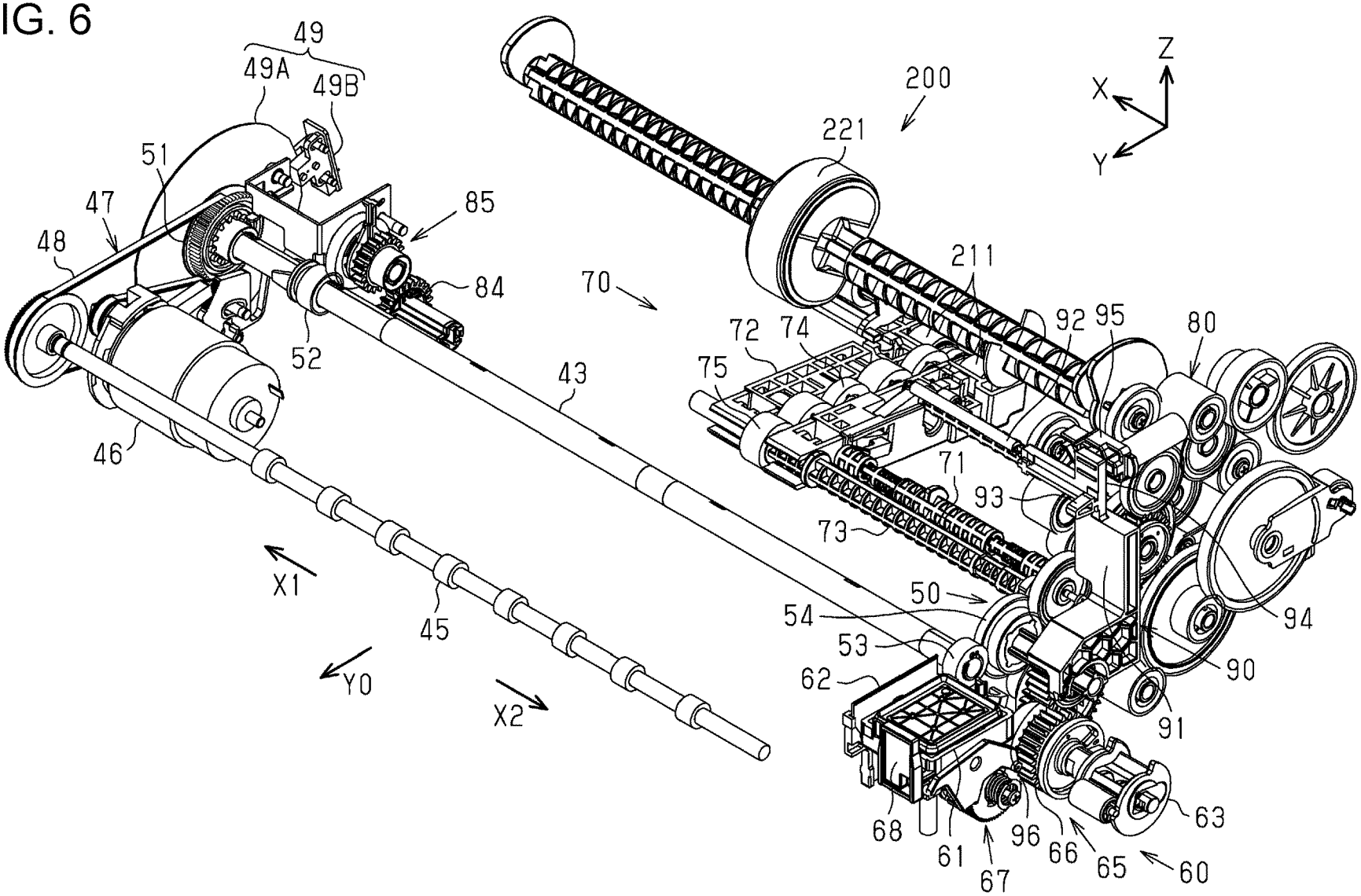
FIG. 6 is a perspective view illustrating a medium transport device.

As illustrated in FIG. 6, the recording apparatus 11 includes a medium transport device 200 that transports the medium M. The medium transport device 200 includes: the pickup roller 211 which is an example of the feeding roller that feeds the medium M; a transport driving roller 43 which is an example of the transport roller that transports the fed medium M toward the recording head 25; and the transport motor 46 which is a common driving source for the pickup roller 211 and the transport driving roller 43. In other words, the transport motor 46 is a common driving source for the feeding section 20 and the transport section 40.

As illustrated in FIG. 6, the medium transport device 200 includes the pickup roller 211 and a lock member 68 which are examples of the movable member other than the transport driving roller 43 of which the driving source is the transport motor 46. The lock member 68 is a member that is engaged with the carriage 24 at the home position HP to lock the carriage 24 to the home position HP. The lock member 68 moves between a lock position engaged with the carriage 24, which is at the home position HP, and an unlock position which is not engaged with the carriage 24.

As illustrated in FIG. 6, the medium transport device 200 includes: a first feeding mechanism 70 which is an example of the power transmission mechanism having a gear that transmits the power of the transport motor 46 to the pickup roller 211; and a maintenance mechanism 65 which is an example of the power transmission mechanism having a gear that transmits the power of the transport motor 46 to the lock member 68. The maintenance mechanism 65 is a gear mechanism that drives the maintenance device 60. Therefore, the cap 61, the wiper 62, and the pump 63, which are movable by the power transmitted to the maintenance mechanism 65, are also respectively examples of the movable member. Furthermore, the medium transport device 200 includes a second feeding mechanism 80 as an example of the power transmission mechanism having a gear that transmits the power of the transport motor 46 to the feeding roller 221, and the feeding roller 221 is also an example of the movable member.

The transport driving roller 43 is rotated by the power of the transport motor 46. The rotation of the transport driving roller 43 is transmitted to the pickup roller 211, the feeding roller 221, and the lock member 68 via the first feeding mechanism 70, the second feeding mechanism 80, and the maintenance mechanism 65, respectively. In other words, the rotational power of the transport driving roller 43 based on the power of the transport motor 46 is transmitted to the pickup roller 211 via the first feeding mechanism 70, and accordingly, the pickup roller 211 rotates. The rotational power of the transport driving roller 43 based on the power of the transport motor 46 is transmitted to the feeding roller 221 via the second feeding mechanism 80, and accordingly, the feeding roller 221 rotates.

The rotational power of the transport driving roller 43 based on the power of the transport motor 46 is transmitted via the maintenance mechanism 65, and accordingly, the cap 61, the wiper 62, and the lock member 68 are raised and lowered. At this time, the cap 61, the wiper 62, and the lock member 68 are driven by the transport motor 46 to be raised and lowered. The pump 63 receives the driving from the transport motor 46 and drives the pump to suction air through the cap 61. The raising and lowering of the cap 61 and the wiper 62 and the raising and lowering of the lock member 68 may be decoupled and capable of being raised and lowered independently. For example, the lock member 68 may be raised and lowered by the power of the transport motor 46, and the cap 61 and the wiper 62 may be raised and lowered by the power of another motor such as a dedicated motor other than the transport motor 46. A mechanical raising and lowering mechanism that raises the cap 61 and the wiper 62 by supporting the cap 61 and the wiper 62 by the slider biased in the downward direction, and by moving the slider obliquely upward against the biasing force while the carriage 24 is engaged with the slider in the process of moving toward the home position HP, may be adopted.

In this manner, as illustrated in FIG. 6, the medium transport device 200 of the embodiment includes the pickup roller 211, the feeding roller 221, the lock member 68, the cap 61, the wiper 62, and the pump 63, which are examples of the plurality of movable members using the transport motor 46 as a common driving source. The medium transport device 200 includes the first feeding mechanism 70, the second feeding mechanism 80, and the maintenance mechanism 65 that transmit the power of the transport motor 46 to these movable members. The transport motor 46 is driven and controlled by the control section 100 illustrated in FIG. 1.

As illustrated in FIG. 6, the medium transport device 200 includes a first switching section 90 and a second switching section 85 which are examples of the switching section that switches between coupling and decoupling of a power transmission path through which the power of the transport motor 46 is transmitted. The first switching section 90 is switched by moving the carriage 24 to a plurality of switching positions set at positions closer to the home position HP on the scanning path. The first switching section 90 switches the power transmission path for transmitting the power of the transport motor 46 to the pickup roller 211 or the lock member 68, which are examples of the movable member other than the transport roller pair 41 and the discharge roller pair 42. The second switching section 85 is switched by moving the carriage 24 to a predetermined switching position positioned closer to the opposite-home position AH on the scanning path. When the second switching section 85 is switched by being pushed by the carriage 24, the power of the transport motor 46 is transmitted to the upper cassette (not illustrated) via a gear 84. The upper cassette is positioned above the cassette 27, and the upper cassette can accommodate a plurality of paper sheets and is attachable to and detachable from the apparatus main body 12 independently of the cassette 27. Even in a state where one side is in a non-mounted state, when the other side is mounted, the medium M can be sent out from the mounted cassette.

The upper cassette is provided to movable between a feeding position where the medium M can be fed by the first feeding section 21 and a non-feeding position displaced in the +Y axial direction along the medium feeding direction from the feeding position, and moves between the feeding position and the non-feeding position by receiving the power of the transport motor 46 or an external force manually.

The medium transport device 200 includes: a gear group 50 which is an example of the first power transmission mechanism that transmits the rotational power of the transport driving roller 43 rotated by the power of the transport motor 46; and the first feeding mechanism 70 which is an example of the second power transmission mechanism that transmits the rotational power of the gear group 50 to the pickup roller 211. The first switching section 90 switches between the coupled state and the decoupled state of the gear group 50 and the first feeding mechanism 70.

Figure 7:
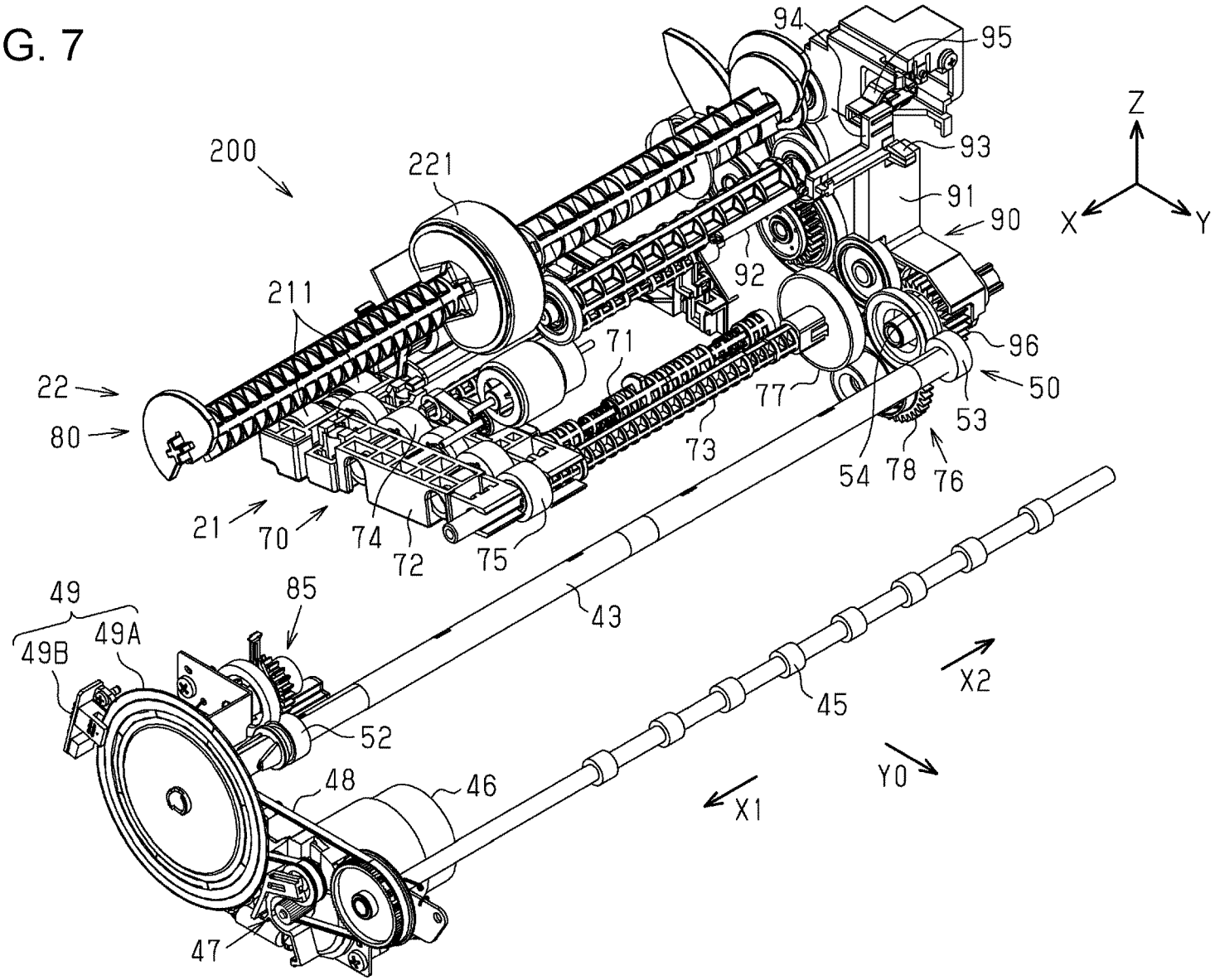
FIG. 7 is a perspective view illustrating the medium transport device.

The pickup rollers 211 illustrated in FIG. 7 are paired and attached in a state of being rotatable around the distal end portion of a swing member 72 that is swingably supported by a support frame (not illustrated) in the apparatus main body 12 around a swing shaft 71. A rotary shaft 73 extending along the width direction X parallel to the swing shaft 71 is rotatably supported by the swing member 72. The power of the transport motor 46 is transmitted to the pickup roller 211 via a gear train 74 provided in the swing member 72 via the transport driving roller 43, the gear group 50, and the rotary shaft 73. The gear train 74 includes a plurality of gears arranged in a row in a state of being meshed with each other next to each other. The rotary shaft 73 is coupled to the most upstream gear 75 that configures the gear train 74. A gear 77 that configures the gear group 76 is attached to the end portion of the rotary shaft 73.

The posture angle of the swing member 72 is changed by the rotation of the swing shaft 71. The swing shaft 71 biases the swing member 72 in the direction in which the pickup roller 211 comes into contact with the medium M by the elastic force of an elastic member (not illustrated) such as a torsion spring. The cassette 27 can be inserted into and removed from the opening of the apparatus main body 12. In the recording apparatus 11, in the process of removing the cassette 27 from the apparatus main body 12, the swing member 72 has a mechanism for moving the pickup roller 211 to a holding position away from the medium M on the cassette 27. In the process of inserting and attaching the cassette 27 to the apparatus main body 12, the swing member 72 moves from the separated position to the feeding position where the pickup roller 211 comes into contact with the medium M.

The power of the transport motor 46 is transmitted to a gear 51 fixed to the first end portion, which is the end portion on the opposite-home position AH side of the transport driving roller 43, via the power transmission mechanism 47. The rotation of the gear 51 causes the transport driving roller 43 to rotate. When the transport motor 46 is driven to be rotated forwardly, the transport driving roller 43 and the discharge driving roller 45 rotate forwardly in the direction in which the medium M can be transported in the transport direction Y0. During recording by the recording apparatus 11, the medium M is transported in the transport direction Y0 by driving the transport motor 46 to be rotated forwardly. A gear 52 positioned in the vicinity of the first end portion in the axial direction thereof and a gear 53 positioned at the second end portion opposite to the first end portion are fixed to the transport driving roller 43. The gear 53 meshes with one input gear 54 that configures the gear group 50.

The recording apparatus 11 includes the first switching section 90 and the second switching section 85 which are examples of the switching section in which the power transmission path of the transport motor 46 is switched by the carriage 24. The first switching section 90 includes a slider 91 that is movably provided in the width direction X. The slider 91 is biased by the elastic force of the elastic member 92 in a first direction X1 in which the carriage 24 is directed from the home position HP to the opposite-home position AH.

Figure 15:
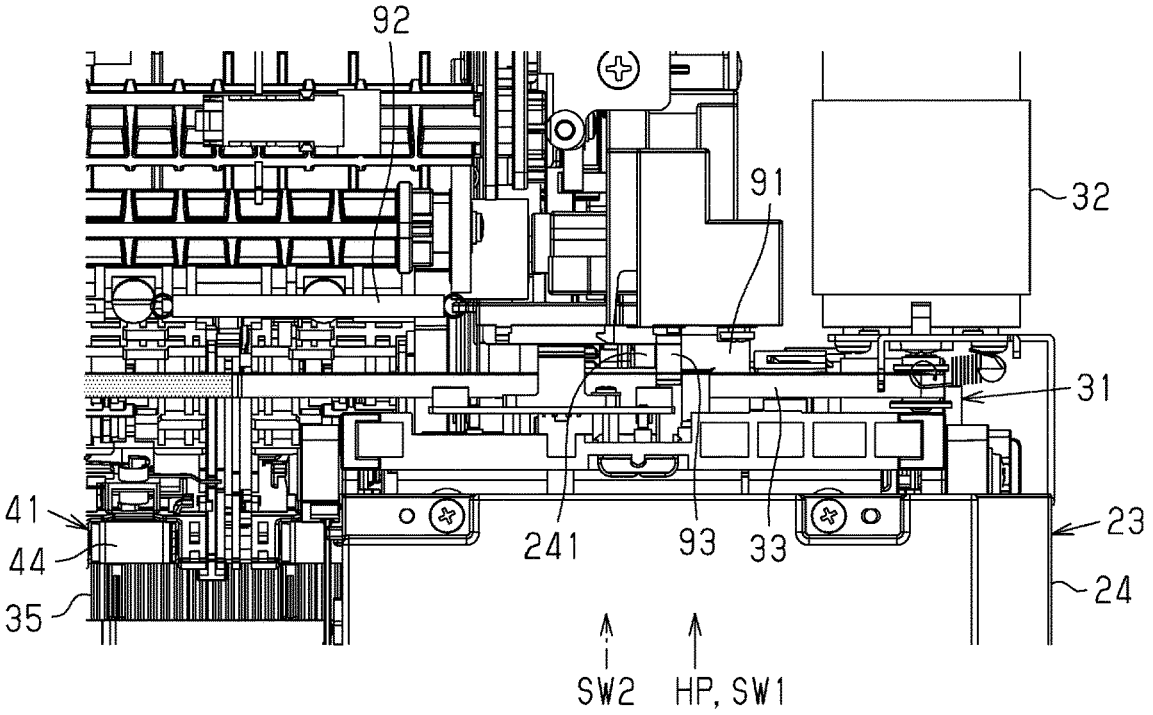
FIG. 15 is a partial plan view illustrating a first switching section and a carriage.

The slider 91 includes an abutting section 93 which can abut in the process in which a protrusion portion 241 (refer to FIG. 15) protruding toward the back surface of the carriage 24 moves together with the carriage 24 in a second direction X2, which is a direction from the opposite-home position AH to the home position HP in the width direction X. The slider 91 has an engaging section 94 on the upper portion thereof. The engaging section 94 is engaged with a cam member 95 provided at a position facing the back surface thereof. The slider 91 has a switching gear 96 on the lower side thereof. The switching gear 96 moves in the width direction X together with the slider 91.

The carriage 24 moves to the home position HP, which is a standby position, a feed coupling position SP, which is separated from the home position HP by a short predetermined distance in the first direction X1, and a feed decoupling position, which is a position between the home position HP and the feed coupling position HP, as switching positions for switching the first switching section 90. When the carriage 24 is at the home position HP, the slider 91 is disposed at a first switching position SW1 when the carriage 24 is locked to the home position HP. When the carriage 24 is at the feed coupling position SP, the slider 91 is disposed at a second switching position SW2 when driving the first feeding section 21. When the carriage 24 is at the feed decoupling position FP, which is a position on the second direction X2 side of the feed coupling position SP, the slider 91 is positioned at a third switching position SW3. When the carriage 24 is at the position during recording for performing recording on the medium M, which is the position on the first direction X1 side of the second switching position SW2, the slider 91 is disposed at the standby position by the biasing force of the elastic member 92.

Figure 8:
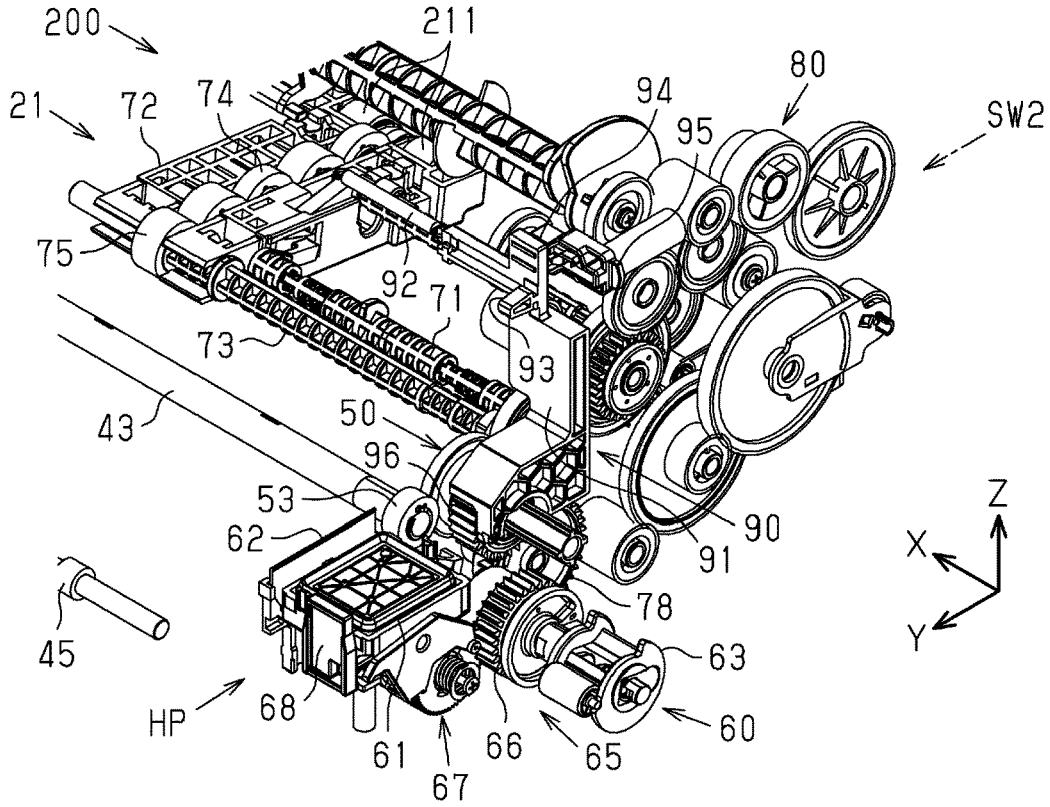
FIG. 8 is a perspective view illustrating a part of the medium transport device.
Figure 9:
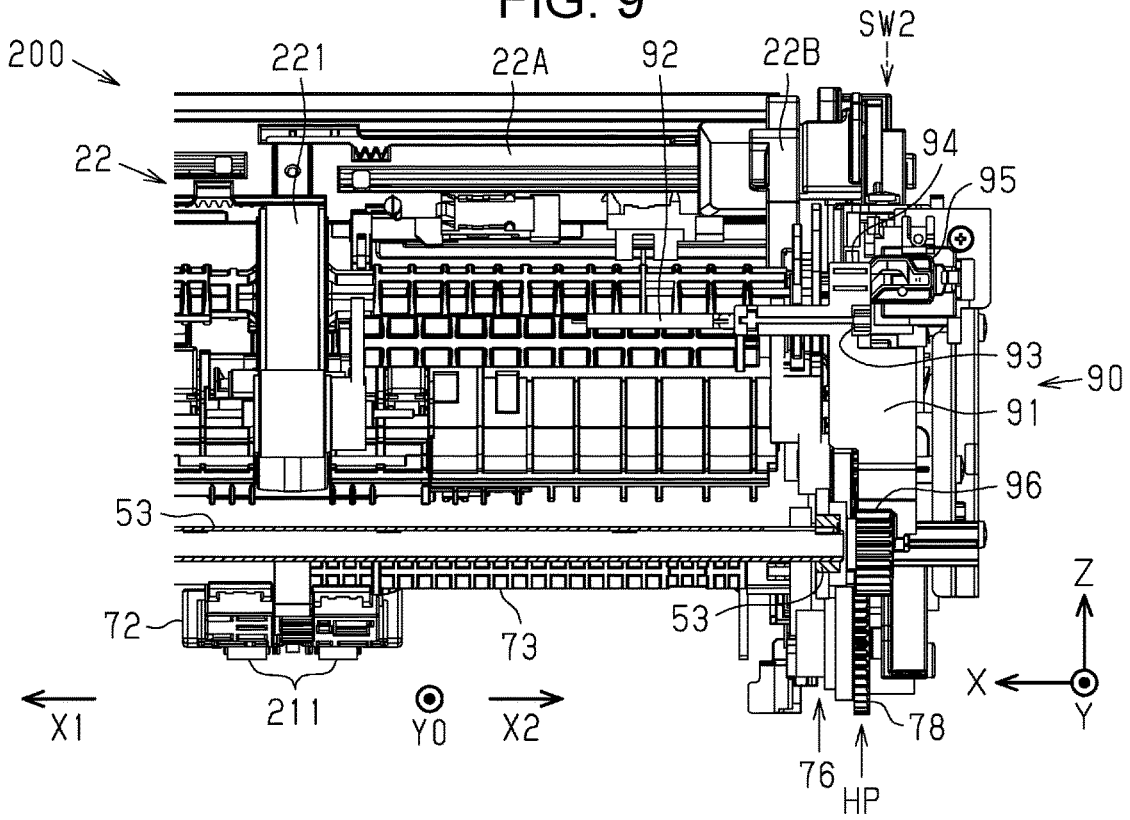
FIG. 9 is a front view illustrating a part of the medium transport device.

FIGS. 8 and 9 illustrate a state where the slider 91 is positioned at the second switching position SW2 when the carriage 24 is at the feed coupling position SP (refer to FIG. 4). As illustrated in FIGS. 8 and 9, when the slider 91 is at the second switching position SW2, the switching gear 96 meshes with a gear 78 (refer to FIG. 9) of a feeding system, and the cam member 95 is disposed at the feeding position for driving the first feeding section 21.

Figure 10:
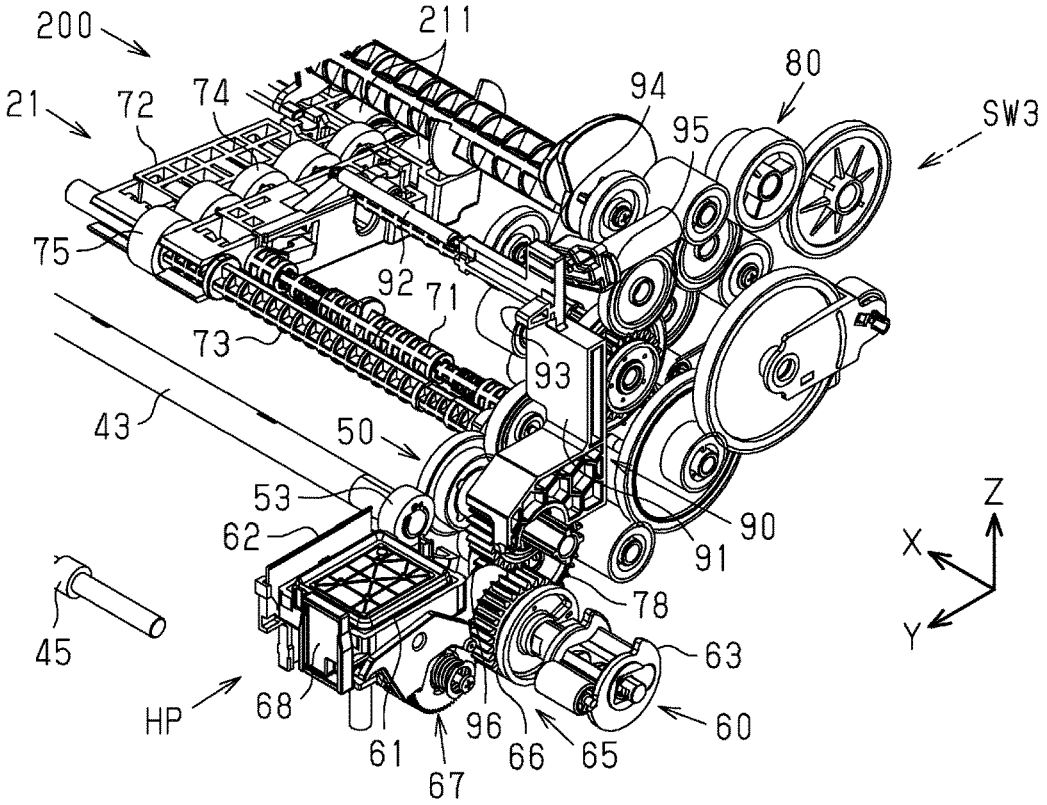
FIG. 10 is a perspective view illustrating a part of the medium transport device.
Figure 11:
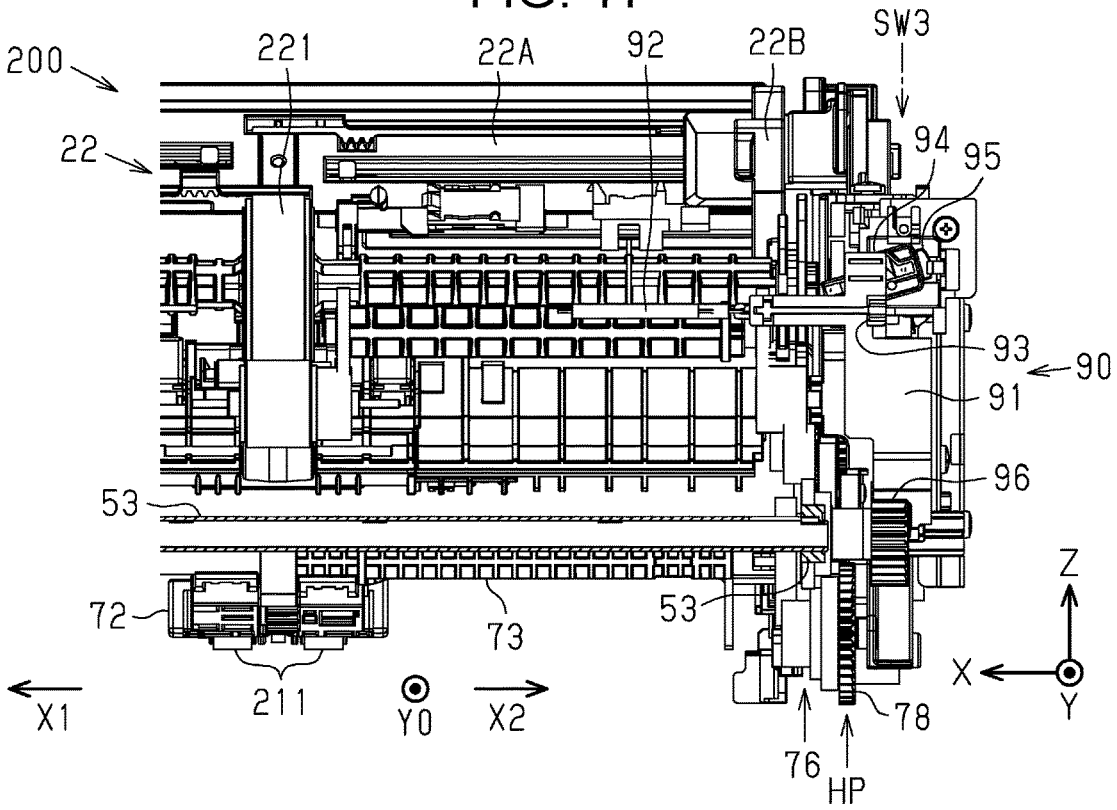
FIG. 11 is a front view illustrating a part of the medium transport device.

FIGS. 10 and 11 illustrate a state where the slider 91 is positioned at the third switching position SW3 when the carriage 24 is at the feed decoupling position FP (refer to FIG. 4). When the slider 91 is at the third switching position SW3, the switching gear 96 is disengaged with the gear 78 (refer to FIG. 11) of a feeding system, and the cam member 95 is disposed at the non-feeding position for not driving the first feeding section 21.

Figure 12:
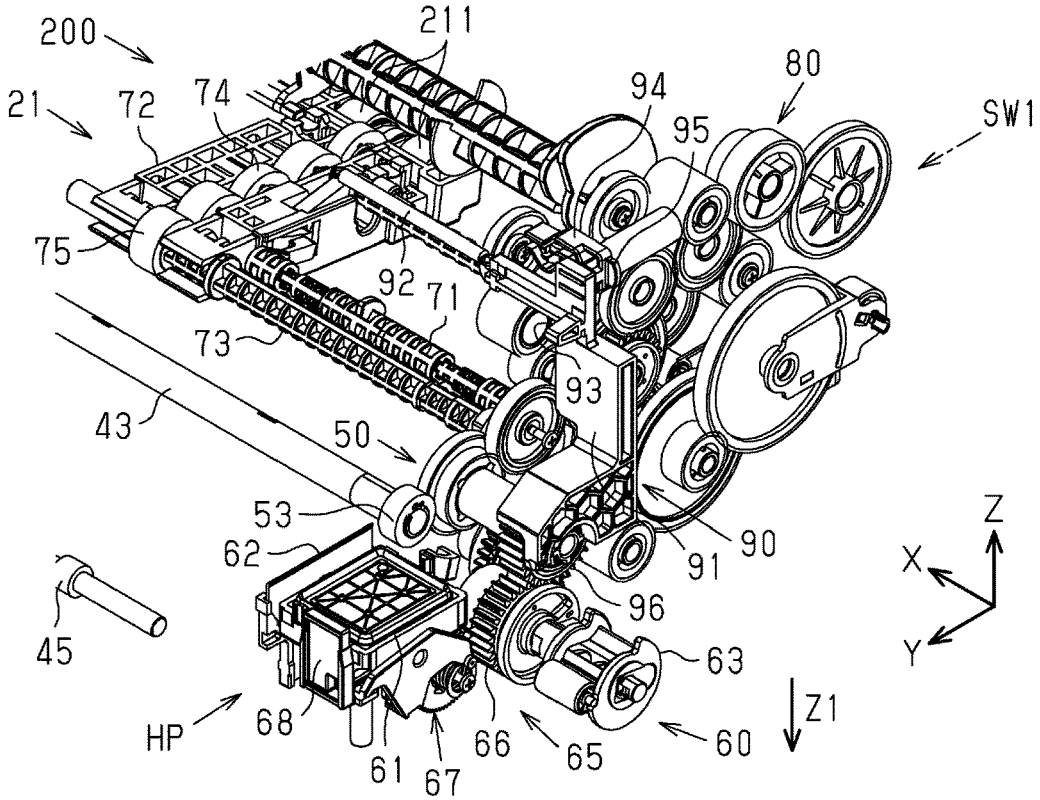
FIG. 12 is a perspective view illustrating a part of the medium transport device.
Figure 13:
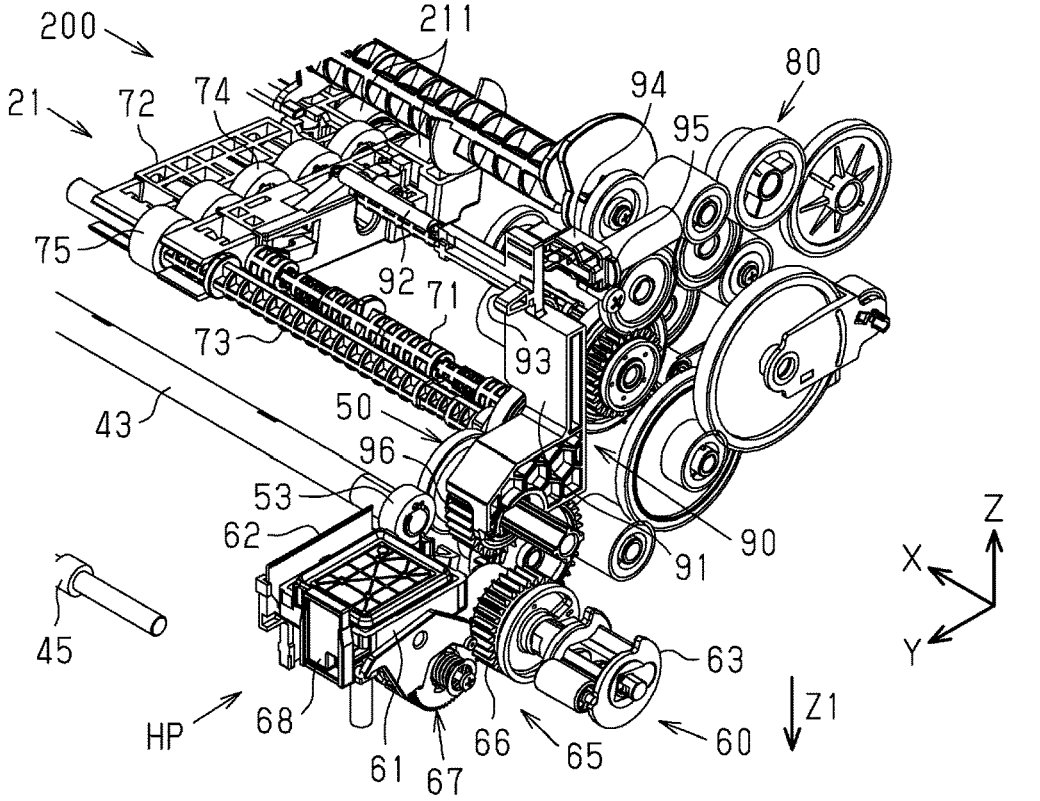
FIG. 13 is a perspective view illustrating a part of the medium transport device.

FIGS. 12 and 13 illustrate the coupling and decoupling of the power transmission path to the maintenance mechanism 65. In other words, FIG. 12 illustrates the coupled state of the power transmission path to the maintenance mechanism 65, and FIG. 13 illustrates the decoupled state of the power transmission path to the maintenance mechanism 65. The maintenance device 60 has the above-described maintenance mechanism 65, which is a driving mechanism thereof. As illustrated in FIGS. 12 and 13, the maintenance mechanism 65 has a gear group 67 including a plurality of gears including a driving gear 66 disposed at a position capable of meshing with the switching gear 96 of the slider 91. The driving gear 66 rotates integrally with the rotary shaft of the pump 63. The gear group 67 is coupled to the raising and lowering mechanism (not illustrated) for raising and lowering the cap 61 in a state where power can be transmitted.

Figure 14:
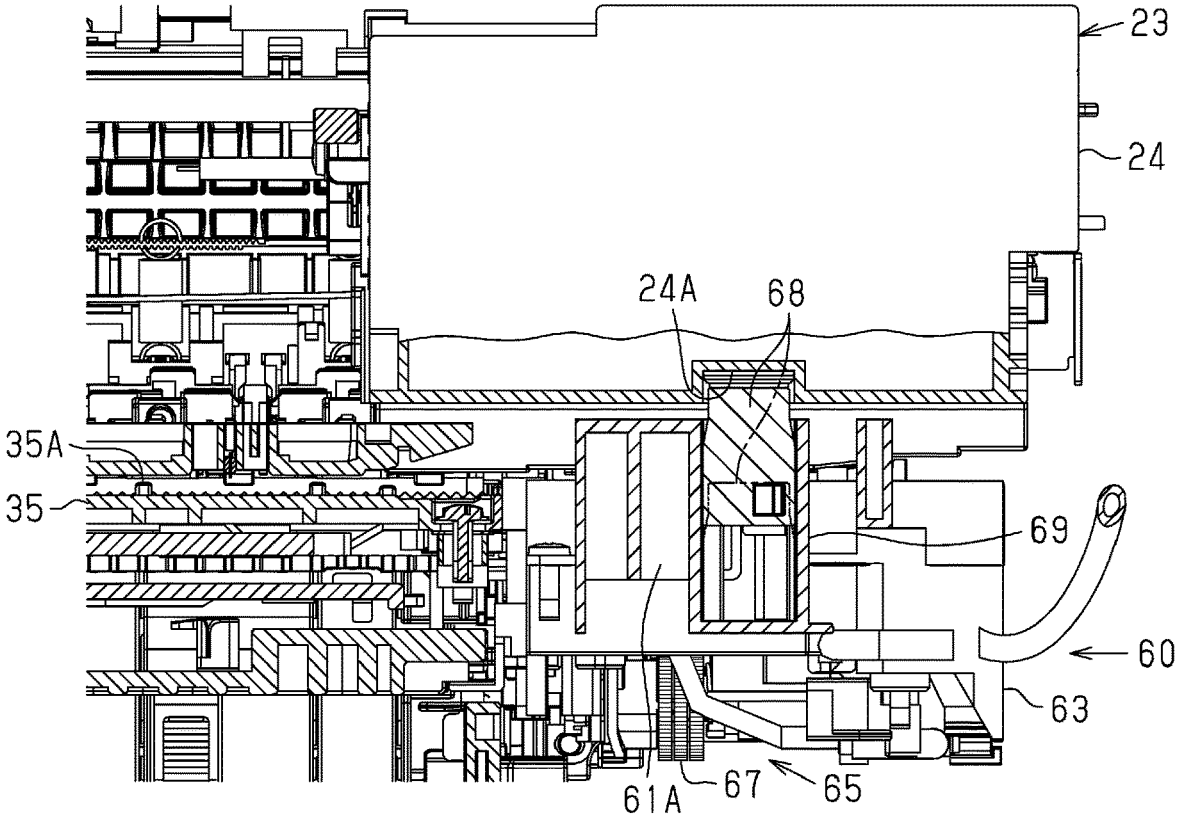
FIG. 14 is a front sectional view illustrating a lock member and a carriage.

As illustrated in FIGS. 12 to 14, the lock member 68 for locking the carriage 24 to the home position HP is fixed to the support section 61A (refer to FIG. 14) that supports the cap 61. The lock member 68 can be raised and lowered together with the cap 61 and the wiper 62. As illustrated in FIG. 14, the carriage 24 has a recessed engaged section 24A at a position facing the lock member 68 on the upper side in the vertical direction when the carriage 24 is at the home position HP. When the lock member 68 is raised in a state where the carriage 24 is at the home position HP, the lock member 68 is engaged with the engaged section 24A and locks the carriage 24 to the home position HP. When the lock member 68 is lowered to the lowering position illustrated by the two-dot chain line in FIG. 14, the carriage 24 is unlocked and the carriage 24 becomes movable from the home position HP.

The recording apparatus 11 includes the lock member 68 engaged with the carriage 24 positioned at the home position HP. The lock member 68 moves between the lock position that is engaged with the carriage 24 and the unlock position that is not engaged with the carriage 24. The carriage 24 is held at the home position HP by moving the lock member 68 to the lock position. When the lock member 68 moves to the unlock position, the carriage 24 becomes movable from the home position HP.

Maintenance Mechanism

The maintenance mechanism 65 includes a raising and lowering mechanism that raises and lowers the cap 61 and the wiper 62 of the maintenance device 60, and the gear 66 that drives the pump 63. The lock member 68 is raised and lowered by the raising and lowering mechanism for raising and lowering the cap 61. Therefore, when the carriage 24 is at the home position HP, the recording head 25 is capped by the raised cap 61, and the carriage 24 is locked at the home position HP by the raised lock member 68.

As illustrated in FIGS. 3 to 5, the transport section 40 includes the transport roller pair 41 positioned on the upstream of both sides holding the medium support member 35 in the transport direction Y0, and the discharge roller pair 42 (refer to FIGS. 4 and 5) positioned on the downstream. As illustrated in FIGS. 3 to 6, the transport roller pair 41 has a configuration in which the transport driving roller 43 and the transport driven roller 44 form a pair. Specifically, the transport roller pair 41 is formed by a pair of one transport driving roller 43 and a plurality of transport driven rollers 44 capable of holding the medium M with the transport driving roller 43. The discharge roller pair 42 is formed by a pair of the discharge driving roller 45 (refer to FIG. 6) and a plurality of discharge driven rollers (not illustrated) capable of holding the medium M with the discharge driving rollers 45. The discharge driven roller is, for example, a jag roller having a plurality of teeth along the outer circumference thereof.

As illustrated in FIGS. 4 and 6, the recording apparatus 11 includes: the transport motor 46 which is the driving source of the transport section 40; and the power transmission mechanism 47 that transmits the power of the transport motor 46 to the transport driving roller 43 and the discharge driving roller 45 (refer to FIG. 6). The power transmission mechanism 47 is a belt type power transmission mechanism including a timing belt 48 that transmits the power of the transport motor 46 to each of the driving rollers 43 and 45. The power transmission mechanism 47 includes the gear 51. The recording apparatus 11 is provided with a rotary encoder 49 that detects the amount of rotation of the transport driving roller 43. The rotary encoder 49 includes: a rotation scale 49A fixed to the end portion of the rotary shaft of the transport driving roller 43; and an optical sensor 49B for detecting the amount of rotation of the rotation scale 49A. The rotary encoder 49 outputs a pulse signal including the number of pulses proportional to the amount of rotation of the transport driving roller 43.

Electrical Configuration of Recording Apparatus

Figure 16:
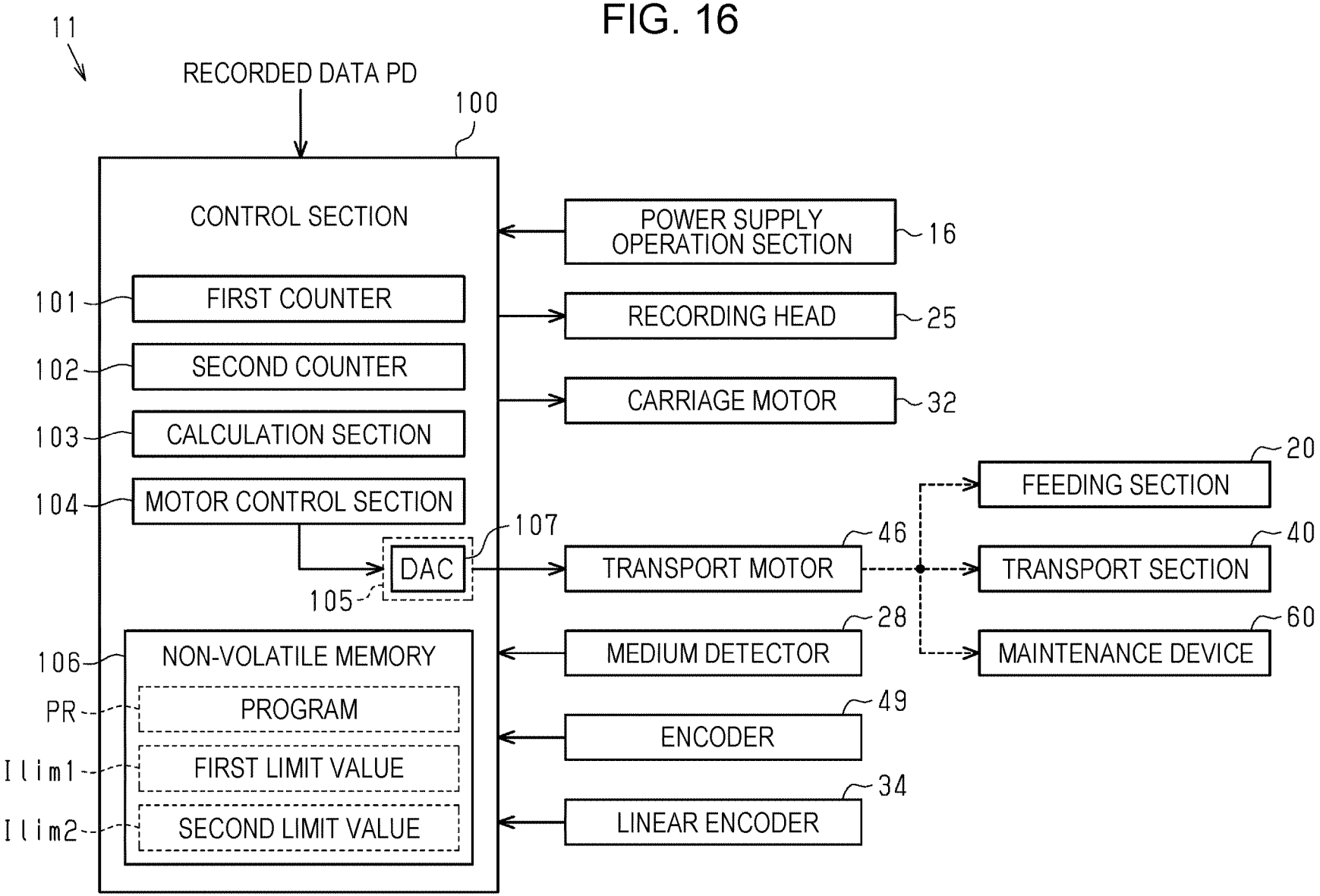
FIG. 16 is a block diagram illustrating an electrical configuration of the recording apparatus.

Next, the electrical configuration of the recording apparatus 11 will be described with reference to FIG. 16. The control section 100 performs various controls including recording control for the recording apparatus 11. The control section 100 includes one or more processors that operate according to a computer program (software). The processor includes a CPU and a memory such as a RAM and a ROM, and the memory stores a program code or a command configured to cause the CPU to execute processing. The control section 100 is not limited to the one that performs software processing. For example, the control section 100 may include a dedicated hardware circuit (for example, an integrated circuit for a specific application: ASIC) that performs hardware processing for at least a part of the processing executed by itself.

The recording head 25, the carriage motor 32, and the transport motor 46 are electrically coupled to the control section 100 as an output system. The control section 100 controls the recording head 25, the carriage motor 32, and the transport motor 46. The power supply operation section 16, a medium detector 28, the linear encoder 34, and the rotary encoder 49 are electrically coupled to the control section 100 as an input system.

The control section 100 includes a first counter 101, a second counter 102, a calculation section 103, a motor control section 104, a motor driver 105, and a non-volatile memory 106. The motor driver 105 includes a D/A converter 107 (hereinafter, also referred to as "DAC 107").

The first counter 101 counts the number of pulse edges of the detection pulse signal input from the rotary encoder 49 by using the position of the medium M when the distal end of the medium M fed by the feeding section 20 is detected by the medium detector 28 as the origin position, and accordingly, the value corresponding to the position of the distal end or the rear end of the medium M is counted. The control section 100 controls the transport motor 46 based on the counted positions of the distal end or the rear end of the medium M, and controls the feed, transport, and discharge of the medium M.

The second counter 102 counts the number of pulse edges of the detection signal input from the linear encoder 34 by using the position when the carriage 24 comes into contact with the end position on the home position HP side and reaches the origin position as the origin point, and accordingly, the carriage position, which is the position in the scanning direction X with respect to the origin position of the carriage 24, is acquired. The control section 100 controls the carriage motor 32 based on the counted value of the carriage position, and accordingly, the speed control and the position control of the carriage 24 are performed.

The calculation section 103 performs various calculations necessary for operating the recording apparatus 11. In the embodiment, the calculation section 103 performs a calculation for calculating a second limit value Ilim2 The calculation section 103 performs calculations such as various setting values necessary for executing a program PR.

The motor control section 104 controls the speed of the transport motor 46 by outputting a current command value to the motor driver 105. The motor control section 104 outputs, for example, a Pulse Width Modulation (PWM) command value to the motor driver 105. The motor driver 105 controls the current supplied to the transport motor 46 by performing PWM control based on the input PWM command value.

The program PR is stored in the non-volatile memory 106. A first limit value Ilim1 and the second limit value Ilim2 are stored in the non-volatile memory 106. The first limit value Ilim1 and the second limit value Ilim2 are upper limit values that limit the current value of the transport motor 46. When driving the transport motor 46, the control section 100 suppresses the current flowing through the transport motor 46 to a limit value or less. Specifically, the current command value output by the motor control section 104 to the motor driver 105 is limited to the limit value or less. Here, the first limit value Ilim1 is a fixed value set in advance, and the second limit value Ilim2 is a variable value set based on the current measurement value of the transport motor 46. The first limit value Ilim1 is set to a predetermined value equal to or less than the rated current of the transport motor 46. The second limit value Ilim2 is set based on a measured current value Imea of the transport motor 46 measured by the control section 100 while driving the transport motor 46. Specifically, the control section 100 measures the current value flowing through the transport motor 46 during driving as a measured current value Imea, and adds a predetermined offset value Iof to the measured current value Imea to set a limit value of the current supplied to the transport motor 46.

The control section 100 performs an initialization operation when the power is turned on. The load measurement mode is entered after the initialization operation at a rate of once for each power-on or for a plurality of times of power-on. In the load measurement mode, the control section 100 drives the transport motor 46 to measure the load applied to the transport motor 46. In the load measurement mode, the control section 100 is performed in a state where the carriage 24 is positioned at the home position HP and the first switching section 90 is at the first switching position SW1. Therefore, in the load measurement mode, the load applied to the transport motor 46 when the pickup roller 211 and the feeding roller 221 are not driven and the transport driving roller 43 and the discharge driving roller 45 are driven is measured as a current value.

The control section 100 controls the current of the transport motor 46 to control the rotation speeds of the transport driving roller 43 and the discharge driving roller 45. In other words, the control section 100 controls a transport speed Vpf at which the transport roller pair 41 and the discharge roller pair 42 transport the medium M by controlling the current of the transport motor 46.

The motor control section 104 controls the transport speed by feedback control. Speed profile data for transport control is stored in the non-volatile memory 106. The speed profile data is data illustrating the correspondence between the position at each unit control interval from the control start position and the target speed. The non-volatile memory 106 stores the speed profile data for each of a plurality of different target transport speeds. The recording apparatus 11 includes a plurality of recording modes. There are a plurality of recording modes including a standard recording mode in which the recording speed is prioritized over the recording quality and a high-definition recording mode in which the recording quality is prioritized over the recording speed. The user selects and inputs the recording mode according to the type of the medium M. When the target transport speed according to the received recording mode is determined, the motor control section 104 reads the speed profile data corresponding to the target transport speed from the non-volatile memory 106. The motor control section 104 outputs a current command value determined based on the speed profile data to the motor driver 105. Here, the speed profile data includes acceleration data and deceleration data. The motor control section 104 uses the speed profile data for acceleration during acceleration control, and uses the speed profile data for deceleration during deceleration control. In the non-volatile memory 106, the target speed of the speed profile data and the corresponding current command value are stored in association with each other.

The motor control section 104 acquires the position for each control interval from the control start position from the first counter 101 that counts the number of pulse edges of the pulse detection signal input from the encoder 49. In other words, the motor control section 104 acquires the current position (current transport position) starting from the control start position based on the counted value of the first counter 101. The motor control section 104 acquires an actual speed Vr from the number of pulse edges per unit time based on the pulse detection signal input from the encoder 49. In the feedback control, the motor control section 104 corrects the current command value so as to reduce a difference $\Delta V$ between the actual speed Vr and the target speed Vt. For example, when the transport load is smaller than the assumed load, the difference $\Delta V$ ($=Vt-Vr$) between the actual speed Vr and the target speed Vt takes a negative value, and thus, the motor control section 104 corrects the current command value to be small. The reduction of the current command value at this time is determined according to the value of the difference $\Delta V$. When the transport load is larger than the assumed load, the difference ΔV (=Vt−Vr) between the actual speed Vr and the target speed Vt takes a positive value, and thus, the motor control section 104 corrects the current command value to be large. The increment of the current command value at this time is determined according to the value of the difference ΔV.

Accordingly, when the transport load is larger than the assumed load, the current command value becomes large. The current value of the transport motor 46 is determined by the current command value. Therefore, the control section 100 can measure the current value of the transport motor 46 from the value of the current command value by the motor control section 104. In the load measurement, the control section 100 measures the current value from the current command value output by the motor control section 104 in the constant speed range after the transport motor 46 reaches the target transport speed, and acquires the measured current value Imea. For example, the control section 100 sets the measured current value Imea from the average value of the current command values at a plurality of points in the constant speed range of the transport motor 46. In the example, the measured current value Imea is acquired as a value corresponding to the current command value. The measured current value Imea converted into a value corresponding to the current value of the transport motor 46 may be acquired.

The load measurement is performed for setting the limit value of the current supplied to the transport motor 46 in order to prevent excessive torque from being applied to configuration elements such as gears of the first feeding mechanism 70 when driving the first feeding section 21. The limit value of the current is used to detect an abnormal load sufficient to damage the gear. The control section 100 detects an abnormal load when the current command value output by the motor control section 104 exceeds the limit value, and causes the motor control section 104 to stop driving the transport motor 46.

In the related art, the current limit value is set based on the assumed maximum load. Therefore, in the initial stage of use start when the load is small, such as immediately after the purchase of the recording apparatus 11, there is a risk that the gear is damaged when an unintended load is applied. In other words, a part of the torque of the transport motor 46 is lost due to sliding resistance or the like, and the remaining part is used for the rotational torque of the rollers or gears. At the initial stage of use start of the recording apparatus 11, even when the output torque of the transport motor 46 is the same, the loss of sliding resistance of the rollers or gears is relatively small, and thus, an excessive rotational torque is likely to be applied to the gears and the like. The torque increases as the speed is reduced according to the gear ratio of the gear train. Therefore, there is a possibility that the gear to which a relatively large torque is applied on the power transmission path of the transport motor 46 is damaged by an excessive torque exceeding the assumed torque.

Meanwhile, when the limit value of the motor current is set low, excessive torque applied to the gears and the like can be suppressed, but there is a possibility that a predetermined operation such as the transport operation of the medium M cannot be appropriately performed due to insufficient torque. Therefore, it is necessary to ensure the torque required for a predetermined operation such as the transport operation while suppressing excessive torque applied to the gears and the like. However, of the output torque of the transport motor 46, the torque applied to the gears and the like and the torque that can be used for the predetermined operation depend on the loss torque due to the sliding resistance of the rotating components such as the rollers or the gears. The loss torque depends on the individual difference of each recording apparatus 11, the cumulative recording time of the recording apparatus 11, the recording frequency, the cumulative number of recorded sheets, and the like.

Therefore, the control section 100 of the embodiment measures the load applied when driving the transport motor 46 as a current value, and adds the predetermined offset value Iof to the measured current value Imea to set the limit value.

In the embodiment, the limit value is set in accordance with the power transmission mechanism of a specific movable member to which a large torque is particularly easily applied, among the plurality of movable members having the transport motor 46 as a common driving source. The specific movable member utilizes the power transmission mechanism including the gears to which a large torque is easily applied due to the gear ratio of the gear train for the transmission of power. In the example, one of the specific movable members is the pickup roller 211. The maximum value of the gear ratio of the gear train used to drive the pickup roller 211 is larger than the maximum value of the gear ratio of the gear train used to drive the transport driving roller 43. Not limited to damage such as tooth chipping of gears, when the power transmission mechanism includes components other than gears, a limit value is set to the extent that damage to those components can be suppressed.

The load measurement in the load measurement mode is performed in a state where the carriage 24 is positioned at the home position HP. In other words, the first switching section 90 is performed under the state of being switched to the first switching position SW1 in which the coupling between the transport driving roller 43 and the first feeding mechanism 70 is decoupled.

The control section 100 drives the transport motor 46 by controlling the current flowing through the transport motor 46. The control section 100 measures the load applied to the transport motor 46 by the current value flowing through the transport motor 46 while driving the transport motor 46, adds the predetermined offset value Iof to the measured current value Imea, and sets the limit value of the current. The second limit value Ilim2 is set based on the measured current value Imea that measures the load of the transport motor 46.

Figure 17:
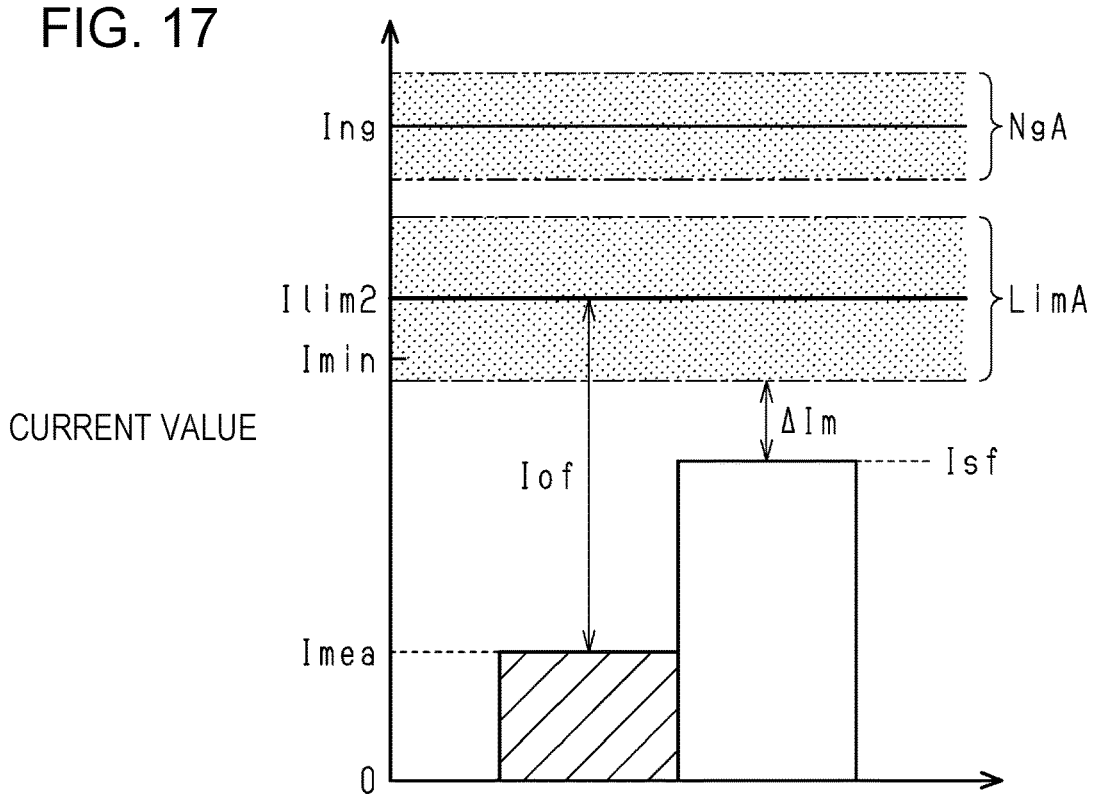
FIG. 17 is a graph describing a method of setting a limit value of a motor current.
Figure 18:
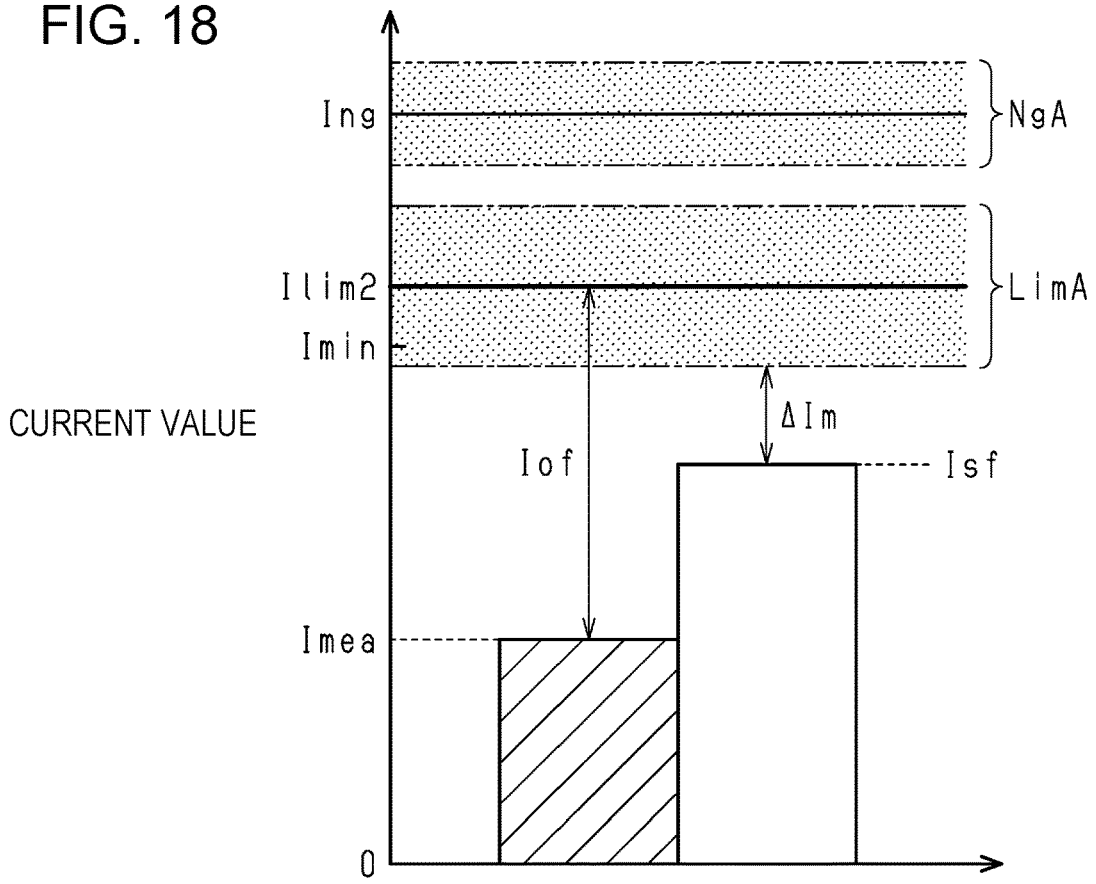
FIG. 18 is a graph describing a method of setting the limit value of the motor current.

Next, a method of setting the second limit value Ilim2 will be described in detail with reference to FIGS. 17 and 18. Here, FIG. 17 illustrates a method of setting the second limit value Ilim2 at the initial stage of use start in which the recording apparatus 11 is unpacked and started to be used. FIG. 18 illustrates a method of setting the second limit value Ilim2 when the recording apparatus 11 is used for nearly the service life thereof.

The recording apparatus 11 of the embodiment, for example, drives the transport motor 46 when the power is turned on when the power supply operation section 16 is operated to measure the load of the transport system applied to the transport motor 46 by driving the transport roller pair 41 or the like. In the measurement mode, the carriage 24 is positioned at the home position HP and the first switching section 90 is at the first switching position SW1. This is because, when the transport motor 46 is driven under the state where the first switching section 90 is switched to the second switching position SW2, the medium M is transported from the cassette 27 at the time of load measurement. Therefore, by performing the load measurement under the state where the carriage 24 is at the home position HP and the first switching section 90 is at the first switching position SW1, it is possible to prevent the medium M from being transported at times other than recording.

In the two graphs illustrated in FIGS. 17 and 18, the value of the second limit value Ilim2 to be set differs depending on the magnitude of the value of the measured current value Imea and the magnitude of the value of the offset value Iof, but the measurement method is the same. Therefore, a method of setting the second limit value Ilim2 will be described based on the graph illustrated in FIG. 17.

When the power is turned on, the control section 100 drives the transport motor 46 while the first switching section 90 is in a non-coupled state, and thus, the load current applied to the transport motor 46 is acquired as the measured current value Imea. In other words, the control section 100 acquires the load current applied to the transport motor 46 as the measured current value Imea under the condition that the feeding section 20 is not driven and the transport section 40 is driven. The calculation section 103 calculates the second limit value Ilim2 by adding the offset value Iof to the measured current value Imea. In this manner, the second limit value Ilim2 is stored in the non-volatile memory 106.

Here, as illustrated in FIG. 17, the second limit value Ilim2 includes various variations. Therefore, the second limit value Ilim2 varies within a variation range LimA.

A value Isf illustrated in FIG. 17 is a current value of the transport motor 46 required to drive the first feeding mechanism in addition to the transport section 40. This fed current value Isf is required in order to make it possible to reliably feed the medium M from the cassette 27. The lower limit value of the variation range LimA is set to be a value obtained by adding a predetermined margin current ΔIm to the fed current value Isf.

In FIG. 17, a value Ing indicates a current value that causes tooth chipping of the gear. The abnormal current value Ing that causes the tooth chipping of the gears varies within a variation range NgA. The second limit value Ilim2 is set such that the upper limit value of the variation range of the second limit value Ilim2 is a smaller value than the lower limit value of the variation range of the abnormal current value Ing.

In the graph illustrated in FIG. 18, as a result of the recording apparatus 11 being used for nearly the service life, the measured current value Imea indicating the load current of the transport motor 46 is larger than the value at the initial stage illustrated in FIG. 17. This increase in load is caused by an increase in the sliding resistance of the rotary shafts of the roller pairs 41 and 42 that configure the transport section 40, wear of the rollers themselves, and the like.

In the embodiment, the second limit value Ilim2 is set for the period during which there is a possibility of occurrence of a problem that components such as gears that configure the power transmission mechanism are damaged due to excessive torque at the time of occurrence of an abnormality such as a jam, when the current having the first limit value Ilim1 flows to the transport motor 46. In the example, the control section 100 sets the limit value to the period during which the power transmission mechanism is most loaded. In this period, the limit value of the current is set to a value smaller than the value set in other periods other than this period.

In the example, the period during which the power transmission mechanism is most loaded at the time of occurrence of an abnormal load is a feeding period ST during which the pickup roller 211 is driven. In the feeding period ST during which the pickup roller 211 is driven, the current limit value is set to the second limit value Ilim2 smaller than the first limit value Ilim1 set in the transport period FT, which is a period other than the feeding period ST.

The recording apparatus 11 includes an operation section that is operated when performing a jam recovery operation on the medium M. In the recording apparatus 11 of the example, a touch panel type display section 15A provided on the operation panel 15 configures an example of the operation section. The first switching section 90 is configured to be switched by moving the carriage 24 on which the recording head 25 is provided to a predetermined switching position on the scanning path that moves in the scanning direction X, which is the direction intersecting the transport direction Y0 of the medium M. In the example, the lock member 68 is configured to move from the lock position to the unlock position when the transport motor 46 is driven to be rotated forwardly in the rotational direction in which the medium M is transported.

The second limit value Ilim2 is also set for other periods during which there is a possibility that the component damage such as missing gears occurs. In the embodiment, the control section 100 makes the transport motor 46 stop in an emergency when an abnormality such as a jam is detected. When the control section 100 receives the recovery operation in which the user who eliminated the jam operates the operation section, in order to move the carriage 24, the control section 100 moves the lock member 68 to the unlock position to perform the carriage unlock operation for unlocking the carriage 24. Even in a carriage unlock operation period LT (refer to FIG. 20), the control section 100 sets the second limit value Ilim2. This is because, at the time of occurrence of an abnormality such as a jam, the user performs the removal work of removing the jammed medium M, but there is a case where the user operates the operation section to perform the recovery operation without removing the medium M.

In a state where the jammed medium M remains, when other operations are performed in which the transport motor 46 is driven in the forward rotational direction, which is the rotational direction for transporting the medium M in the transport direction Y0, the transport driving roller 43 rotates in the direction of accelerating the jam, and thus, an excessive current flows through the transport motor 46. This excessive current applies excessive torque to the gear and causes damage to the gear. Therefore, in the embodiment, in the operation period during which there is a possibility that the transport motor 46 is driven to be rotated forwardly in a state where the jammed medium M remains, the limit value of the current of the transport motor 46 is set to the second limit value Ilim2 smaller than the first limit value Ilim1.

At the time of occurrence of an abnormality such as a jam, there are a case where the power of the recording apparatus 11 is not turned off and information indicating occurrence of the abnormality is displayed on the display section 15A of the operation panel 15, and a case where the power of the recording apparatus 11 is forcibly turned off. In the former case, the user performs the recovery operation by operating the touch panel type operation section after removing the jammed medium M. In the latter case, the user performs the recovery operation by operating the power supply operation section 16 after removing the jammed medium M.

When the control section 100 detects a jam of the medium M during recording, the carriage 24 is moved to the home position HP, and when the carriage 24 reaches the home position HP, the transport motor 46 is driven to be rotated reversely to move the lock member 68 from the unlock position to the lock position. Accordingly, the carriage 24 is made to stand by in a locked state at the home position HP. The control section 100 displays on the display section 15A information indicating that a jam occurred and prompting the elimination of the jam. When the user who sees this information removes the jammed medium M from the recording apparatus 11, and the user performs the recovery operation for operating the power supply operation section 16 or the selection operation section. When the control section 100 receives the recovery operation by the operation section, the control section 100 sets the second limit value Ilim2 and then drives the transport motor 46 to be rotated forwardly to move the lock member 68 from the lock position to the unlock position. When the carriage 24 is unlocked, the control section 100 changes the limit value of the current from the second limit value Ilim2 to the first limit value Ilim1.

Figure 19:
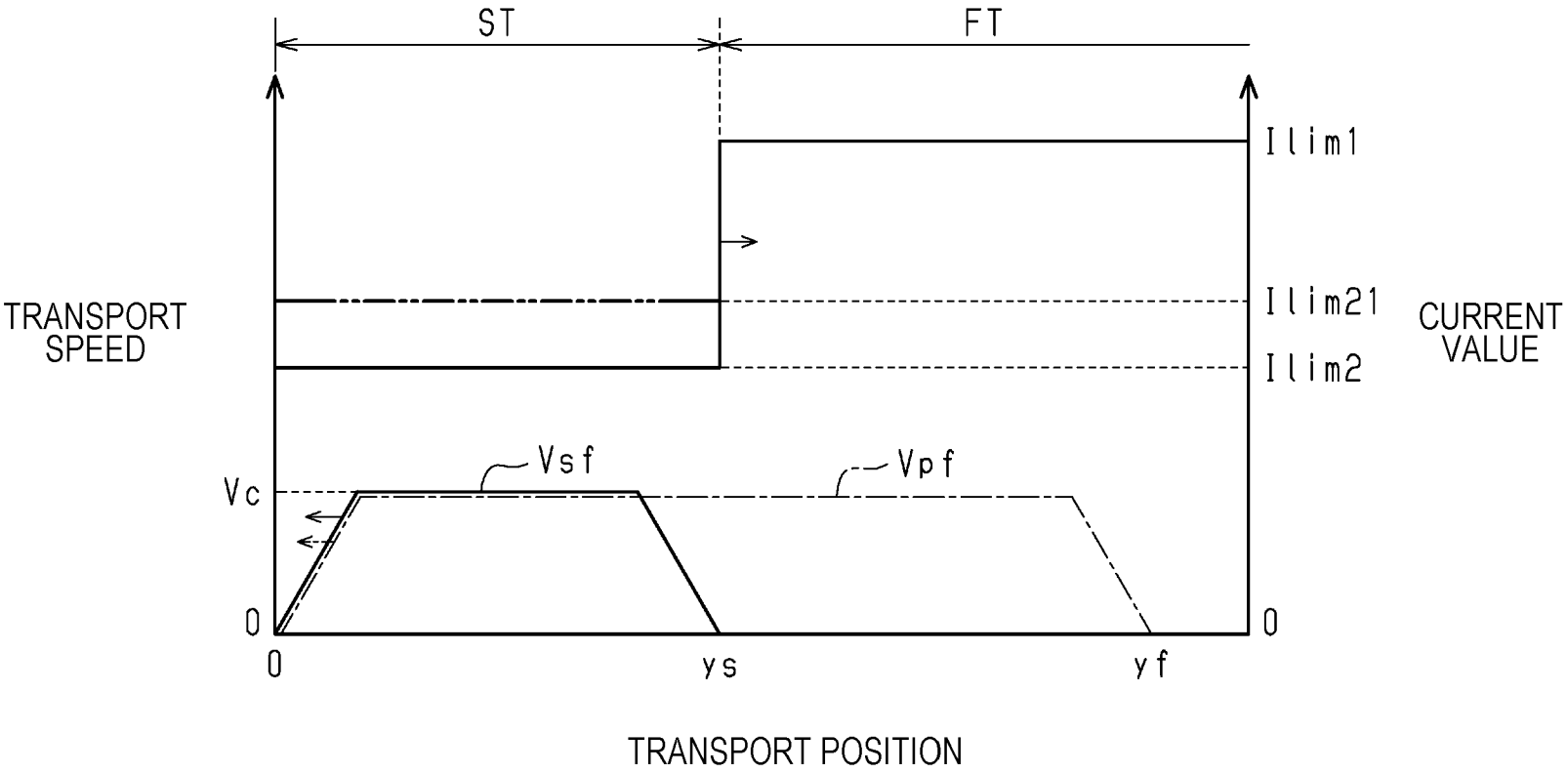
FIG. 19 is a graph illustrating the limit value set for a feeding period and a transport period.

FIG. 19 is a graph illustrating the setting contents of the limit value of the current in the feeding period and the transport period. The horizontal axis indicates the transport position of the medium M, the vertical axis on the left side indicates the transport speed, and the vertical axis on the right side indicates the current value of the transport motor 46. In this graph, a feeding speed Vsf and the transport speed Vpf are illustrated. In the feeding period ST, the pickup rollers 211 and the driving rollers 43 and 45 are driven. In the transport period FT, only the driving rollers 43 and 45 of the pickup rollers 211 and the driving rollers 43 and 45 are driven. When the recording apparatus 11 is a serial printer, the recording medium M is intermittently transported during recording, but in the graph of FIG. 19, acceleration and deceleration in the intermittent transport region are depicted as waveforms that are ignored.

As illustrated in FIG. 19, the period for changing the limit value of the current to a small value is in least a part of the feeding period ST during which the pickup roller 211 is driven, including the maximum speed range of the pickup roller 211. The maximum speed range indicates a constant speed range in which the feeding speed Vsf is a constant speed Vc which is the maximum speed. In the example illustrated in FIG. 19, the period during which the limit value of the current changes to a small value is the entire period of the feeding period ST during which the pickup roller 211 is driven. In other words, the limit value of the current of the transport motor 46 is set to the second limit value Ilim2 in the feeding period ST during which the first switching section 90 is positioned at the second switching position SW2.

In at least a part of the feeding period ST during which the pickup roller 211, which is an example of the movable member, is driven, the control section 100 sets the second limit value Ilim2 smaller than the first limit value Ilim1 set for the transport period FT, which is a period during which the pickup roller 211 is not driven.

Specifically, the speed profile of the feeding speed Vsf in the feeding period ST includes the acceleration range, the constant speed range, and the deceleration range. The period for changing the limit value of the current to a small value may be a part of the feeding period ST including at least the constant speed range. In the example, as illustrated in FIG. 19, the limit value of the current is set to the second limit value Ilim2 in the entire feeding period ST including the acceleration range, the constant speed range, and the deceleration range.

When the carriage 24 moves to the feed coupling position SP, the first switching section 90 is switched to the second switching position SW2. At this time, the cam member 95 operates at the feeding position. By holding the cam member 95 at the feeding position, even when the carriage 24 leaves the feed coupling position SP, the first switching section 90 is held at the second switching position SW2 while the cam member 95 is at the feeding position. In other words, the slider 91 is held at the second switching position SW2.

The control section 100 switches from the feeding period ST to the transport period FT by switching the first switching section 90 from the second switching position SW2 to the third switching position SW3 by the operation of the carriage 24. When this switching is performed, the control section 100 changes the limit value of the current from the second limit value Ilim2 to the first limit value Ilim1.

The feeding period ST is a period during which the pickup roller 211 comes into contact with the recording target medium M in the cassette 27 and sends out the medium M. Therefore, the feeding period ST changes according to the medium length, which is the length of the medium M in the transport direction Y0.

In FIG. 19, a position ys of the medium M in the transport direction Y0 when the feeding period ST ends is a position when the rear end of the medium M being recorded is detached from the pickup roller 211. When the control section 100 determines that the medium M reached the position ys based on the counted value of the first counter 101, the feeding period ST is ended by the operation of the carriage 24. For example, when the carriage 24 moves to a predetermined position on the second direction X2 side of the feed coupling position SP, the holding of the cam member 95 at the feeding position is released. By this release, the slider 91 of the first switching section 90 is reset to the standby position. The pickup roller 211 stops rotating due to the end of the feeding period ST. Therefore, the succeeding medium M is not fed from the cassette 27. The succeeding medium M is in a state of being spaced from the rear end of the preceding medium M, or in a state where the rear end portion of the preceding medium M and the distal end portion of the succeeding medium M partially overlap each other, the feeding of the succeeding medium M may be started during the recording of the preceding medium M.

Incidentally, when the medium M is jammed in the feeding period ST, the current value of the transport motor 46 exceeds the second limit value Ilim2, and thus, the driving of the transport motor 46 is stopped at that point. When the medium M is jammed in the transport period FT, the current value of the transport motor 46 exceeds the first limit value Ilim1, and thus, the driving of the transport motor 46 is stopped at that point. When the control section 100 detects a jam and stops the transport motor 46 in an emergency, the control section 100 drives the carriage motor 32 to move the carriage 24 to the home position HP. The control section 100 moves the lock member 68 from the unlock position to the lock position by driving the transport motor 46 to be rotated reversely. Accordingly, the lock member 68 is engaged with the carriage 24, and the carriage 24 is held at the home position HP. Here, there is a jam which is detected when the medium M is clogged in the pickup roller 211, the transport roller pair 41, or the discharge roller pair 42 and the current value of the transport motor 46 exceeds the limit value, and there is a jam which is detected as the carriage 24 comes into contact with the medium M and the current value of the carriage motor 32 exceeds the limit value due to the large load.

Figure 20:
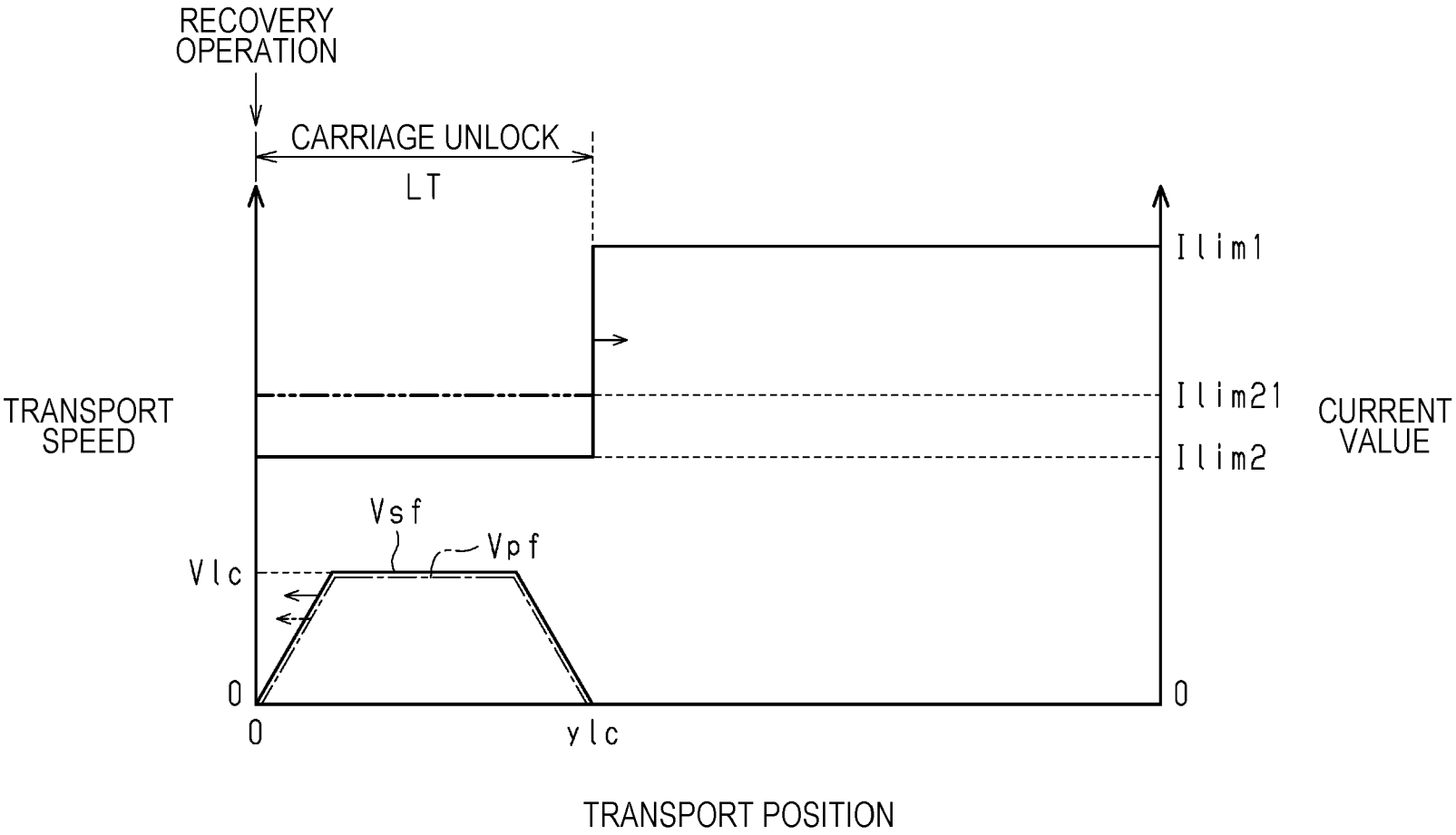
FIG. 20 is a graph illustrating the limit value set during a recovery operation.

FIG. 20 is a graph illustrating the limit value of the current set after receiving the recovery operation by a user after occurrence of an abnormality such as a jam. The recovery operation is an operation not related to the transport, but the transport motor 46 is driven by the carriage unlock operation of the lock member 68. Therefore, in FIG. 20, the carriage unlock operation is illustrated by a graph in which the horizontal axis indicates the transport position, the vertical axis on the left side indicates the transport speed, and the vertical axis on the right side indicates the current value.

As illustrated in this graph, when the control section 100 receives the recovery operation, the carriage unlock operation for moving the lock member 68 from the lock position to the unlock position is performed. In the embodiment, since the lock member 68 uses the transport motor 46 as a driving source, the driving rollers 43 and 45 of the transport system are driven together with the lock member 68 when the lock member 68 is driven. When the emergency stop of the transport motor 46 is performed in the feeding period ST, there is a case where the switching gear 96 and the gear 78 mesh with each other when the recovery operation is performed. In this case, when the transport motor 46 is driven for the recovery operation, the pickup roller 211 is driven. Therefore, in FIG. 20, the feeding speed Vsf and the transport speed Vpf are illustrated.

The recovery operation is an operation of reciprocating the carriage 24 and confirming that there is no jammed medium M that interferes with the carriage 24 on the scanning path. When the recovery operation is received, the carriage unlock operation for unlocking the carriage 24 is first performed in order to cause the carriage 24 to perform the recovery operation. Since this carriage unlock operation is performed by driving the transport motor 46 to be rotated forwardly, among the transport driving roller 43, the discharge driving roller 45, and the pickup roller 211, at least the transport driving roller 43 and the discharge driving roller 45 rotate. At this time, when the jammed medium M remains on the transport path, the jam is further aggravated and the load applied to the transport motor 46 increases. At this time, when the pickup roller 211 is in a state of being capable of being driven, there is a possibility that an excessive torque is applied to the gears that configure the first feeding mechanism 70 during the carriage unlock operation, resulting in damage or the like. Therefore, in the carriage unlock operation period LT, the second limit value Ilim2 of which the limit value of the current is the same as that in the feeding period ST is set.

Next, the operation of the recording apparatus 11 will be described.

Figure 21:
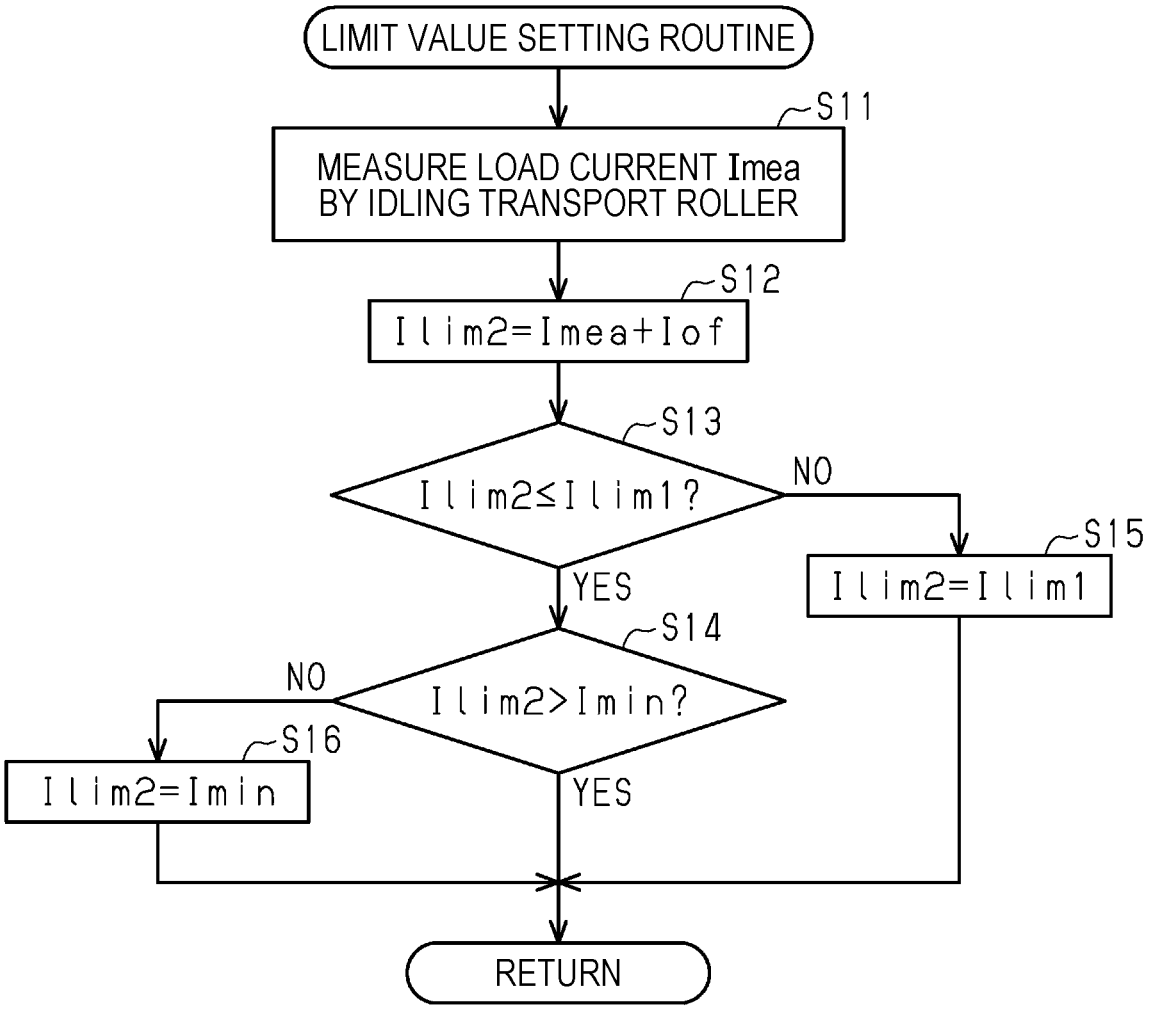
FIG. 21 is a flowchart illustrating a limit value setting routine.

When the power of the recording apparatus 11 is turned on, the control section 100 executes the limit value setting routine illustrated in FIG. 21.

First, in step S11, the control section 100 idles the transport motor 46 to measure the load current Imea. The control section 100 drives the transport motor 46 in a state where the carriage 24 is positioned at the home position HP. Since the home position HP is the first switching position SW1 of the first switching section 90, the pickup roller 211 and the feeding roller 221 are not driven even when the transport motor 46 is driven. Therefore, the transport driving roller 43 and the discharge driving roller 45 idle without transporting the medium M. The control section 100 measures the current value during driving of the transport motor 46 from the current command value in the constant speed range. At this time, the loads of the transport driving roller 43, the discharge driving roller 45, and the power transmission mechanism of the transport system are measured. The measured load current is acquired as the measured current value Imea.

In step S12, the control section 100 calculates the second limit value Ilim2 by Ilim2=Imea+Iof. This calculation is performed by the calculation section 103 of the control section 100.

In step S13, the control section 100 determines whether or not Ilim2≤Ilim1. When Ilim2≤Ilim1, the control section 100 proceeds to step S14, and when Ilim2≤Ilim1, the control section 100 proceeds to step S15.

In step S15, the control section 100 sets Ilim2=Ilim1. In other words, the control section 100 sets the first limit value Ilim1 as the maximum value, and when the calculated second limit value Ilim2 exceeds the first limit value Ilim1, the control section 100 sets the second limit value Ilim2 to the first limit value Ilim1.

In step S14, the control section 100 determines whether or not Ilim2>Imin Here, Imin is the lower limit of the second limit value. When Ilim2>Imin, the control section 100 ends the routine, and when Ilim2>Imin is not satisfied, the control section 100 proceeds to step S16.

In step S16, the control section 100 sets Ilim2=Imin. In other words, when the calculated second limit value Ilim2 is equal to or less than the lower limit value Imin, the control section 100 sets the second limit value Ilim2 to the lower limit value Imin. In this manner, the second limit value Ilim2 is set by the limit value setting process. The control section 100 stores the second limit value Ilim2 in the non-volatile memory 106.

At the initial stage of use start of the recording apparatus 11, the second limit value Ilim2 illustrated in FIG. 17 is set. At the end of the service life of the recording apparatus 11, the second limit value Ilim2 illustrated in FIG. 18 is set. As the recording apparatus 11 is used, the sliding resistance of the rollers 43, 45, and 211 or the power transmission mechanism increases. Therefore, the measured current value Imea increases as the cumulative usage time of the recording apparatus 11 increases. The load on the pickup roller 211 and the power transmission mechanism of the feeding system increases as the cumulative usage time of the recording apparatus 11 increases. Therefore, the offset value Iof is set to a value that gradually increases as the cumulative usage time of the recording apparatus 11 increases. The non-volatile memory 106 stores data indicating the correspondence between the parameter indicating the cumulative usage amount of the recording apparatus 11 and the offset value Iof. An example of the parameter of the cumulative usage amount is the cumulative usage time. Other examples include cumulative number of recorded sheets, cumulative ink consumption, and the like. The control section 100 measures the cumulative usage amount of the recording apparatus 11, and stores the measured cumulative usage amount in the non-volatile memory 106. The control section 100 acquires the offset value Iof corresponding to the cumulative usage amount read from the non-volatile memory 106 at the time of measuring the measured current value Imea. Then, the control section 100 measures the measured current value Imea as a value that increases as the cumulative usage time increases.

Figure 22:
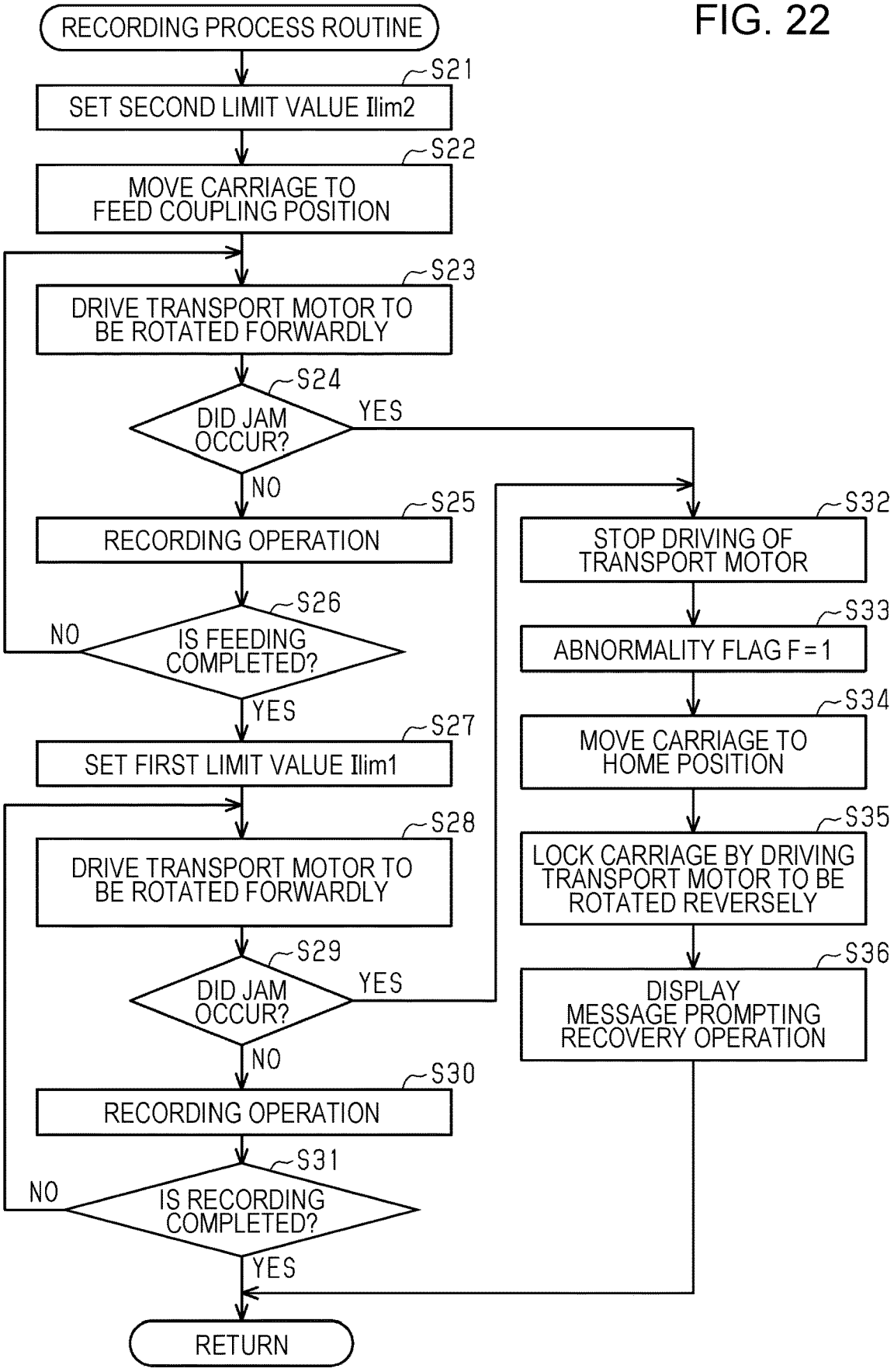
FIG. 22 is a flowchart illustrating a recording process routine.

Next, the recording process routine executed by the control section 100 will be described. When receiving recorded data PD, the control section 100 executes the recording process routine illustrated in FIG. 22.

First, in step S21, the control section 100 sets the second limit value Ilim2.

In step S22, the control section 100 moves the carriage 24 to the feed coupling position SP. As a result, the slider 91 moves to the second switching position SW2 illustrated in FIGS. 8 and 9, and the switching gear 96 meshes with the gear 78. As a result, the power of the transport motor 46 is switched to a state of being transmittable to the pickup roller 211.

In step S23, the control section 100 drives the transport motor 46 to be rotated forwardly. As a result, the pickup roller 211 rotates, and the uppermost one of the media M in the cassette 27 is fed. The distal end of the medium M is detected by the medium detector 28 during feeding. The first counter 101 counts the number of pulse edges of the detection pulse signal input from the encoder 49 by using the position at which the medium detector 28 detects the distal end of the medium M as an origin point, and accordingly, the first counter 101 counts the counted value corresponding to the transport position, which is the position of the medium M in the transport direction Y0. The medium M is transported by the pickup rollers 211 until the distal end of the medium M reaches the transport roller pair 41. In this feeding period ST, the second limit value Ilim2 is set as the limit value of the current of the transport motor 46. When the distal end of the medium M reaches the transport roller pair 41, the subsequent medium M is transported by the pickup roller 211 and the transport roller pair 41. Furthermore, after this, the medium M is transported by the pickup roller 211, the transport roller pair 41, and the discharge roller pair 42.

In step S24, the control section 100 determines whether or not a jam occurred. In this feeding period ST, the control section 100 detects the jam when the current value commanded by the current command value exceeds the second limit value Ilim2 Therefore, the control section 100 determines whether or not the current value commanded by the current command value exceeds the second limit value Ilim2 When the control section 100 does not detect the jam, the process proceeds to step S25, and when the jam is detected, the control section 100 proceeds to step S29.

In step S25, the control section 100 performs the recording operation. In other words, the control section 100 drives the carriage motor 32 and discharges the liquid from the recording head 25 while moving the carriage 24 in the scanning direction X to performs recording one pass on the medium M.

In step S26, the control section 100 determines whether or not the feeding is completed. In other words, the control section 100 determines whether or not the rear end of the recording target medium M is separated from the pickup roller 211. Here, the control section 100 acquires the medium size information based on the recording condition information included in the recorded data PD, and acquires the medium length from the medium size. The control section 100 acquires the position of the rear end of the medium M from the value obtained by adding the medium length to the position of the distal end of the medium M acquired from the counted value of the first counter 101. The control section 100 determines that the feeding is completed when the position of the rear end of the medium M passes the pickup roller 211. In other words, the control section 100 determines that the feeding period ST ended. When the feeding is not completed, the control section 100 returns to step S23, and when the feeding is completed, the control section 100 proceeds to step S27.

In step S27, the control section 100 sets the first limit value Ilim1 as the limit value of the current.

In step S28, the control section 100 drives the transport motor 46 to be rotated forwardly. As a result, the medium M is transported to the next recording position by the transport roller pair 41 and the discharge roller pair 42.

In step S29, the control section 100 determines whether or not a jam occurred. In this transport period FT, the control section 100 detects the jam when the current value commanded by the current command value exceeds the second limit value Ilim2 Therefore, the control section 100 determines whether or not the current value commanded by the current command value exceeds the second limit value Ilim2 When the control section 100 does not detect the jam, the process proceeds to step S30, and when the jam is detected, the control section 100 proceeds to step S32.

In step S30, the control section 100 performs the recording operation. In other words, the control section 100 drives the carriage motor 32 and discharges the liquid from the recording head 25 while moving the carriage 24 in the scanning direction X to performs recording one pass on the medium M.

In step S31, the control section 100 determines whether or not the recording is completed. When the recording is not completed, the process returns to step S28, and the transport operation (S28), the jam detection (S29), and the recording operation (S30) are repeated until it is determined in step S31 that the recording is completed. When the recording is completed, the control section 100 drives the transport motor 46 to be rotated forwardly to discharge the medium M, after recording, and then ends the routine.

When a jam is detected in either the feeding period ST or the transport period FT, the control section 100 executes the process of step S32. In step S32, the control section 100 stops the driving of the transport motor 46. As a result, when a jam is detected, the driving of the transport motor 46 is forcibly stopped.

In step S33, the control section 100 sets an abnormality flag F to "1" (F=1). In other words, the control section 100 stores the information indicating that the transport motor 46 is driven and stopped due to an abnormality such as a jam in a predetermined storage area of the non-volatile memory 106.

In step S34, the control section 100 moves the carriage 24 to the home position HP. In other words, the control section 100 drives the carriage motor 32 to move the carriage 24 to the home position HP.

In step S35, the control section 100 drives the transport motor 46 to be rotated reversely to lock the carriage 24. In other words, the control section 100 moves the lock member 68 from the unlock position to the lock position by driving the transport motor 46 to be rotated reversely. As a result, as illustrated in FIG. 14, the carriage 24 is locked at the home position HP by engaging the lock member 68 with the carriage 24.

In step S36, the control section 100 causes the display section 15A to display a message prompting the recovery operation. When an abnormality such as a jam is detected, the power of the recording apparatus 11 may be forcibly cut off.

When a jam occurs and the recording operation is suspended, the user who sees the message displayed on the display section 15A removes the jammed medium M. Even when the power is forcibly cut off, the user removes the jammed medium M. After removing the jammed medium M, the recovery operation such as operating the touch panel type OK button displayed on the display section 15A or operating the power supply operation section 16 is performed. The control section 100 that received this recovery operation executes the recovery process routine illustrated in FIG. 23.

Figure 23:
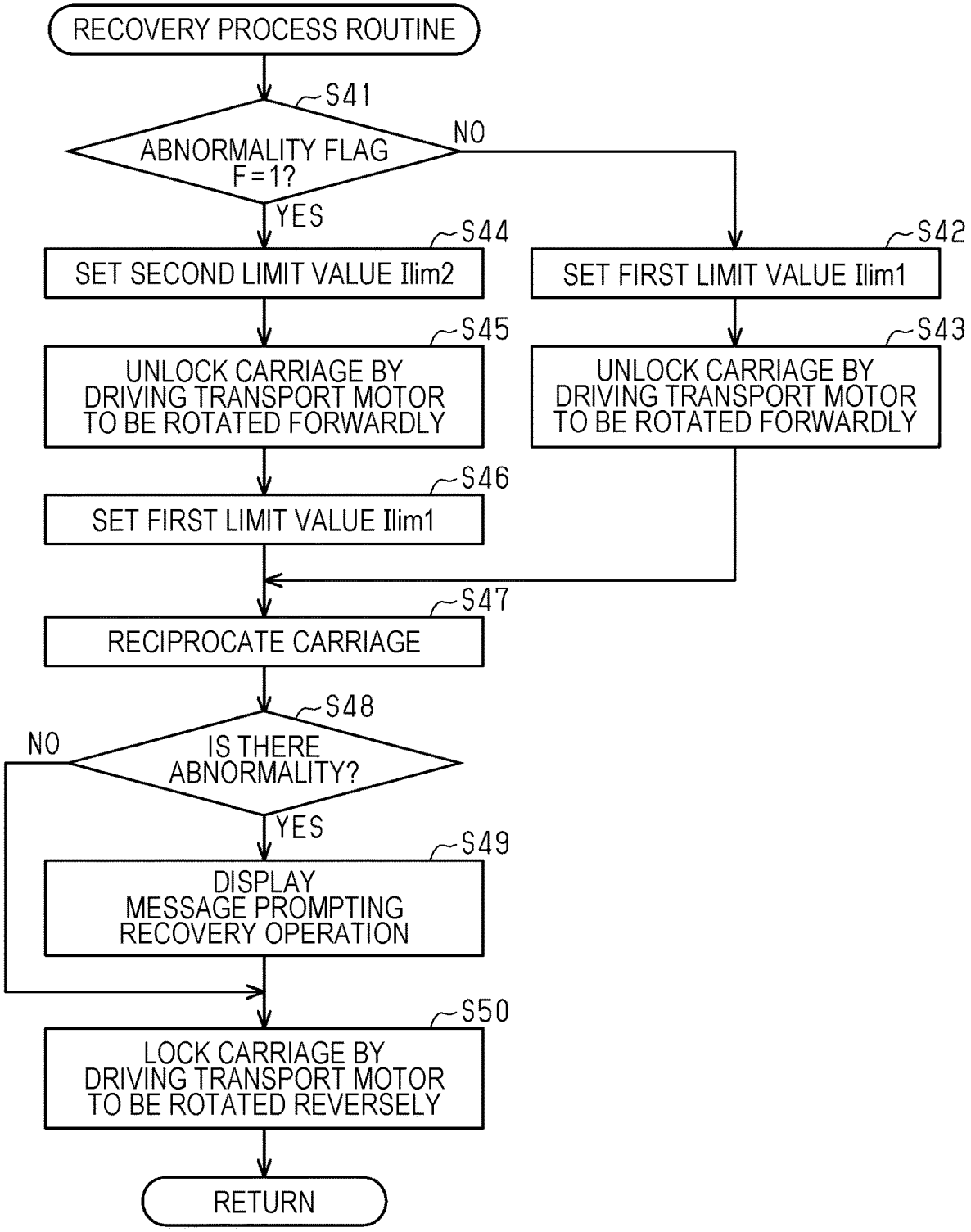
FIG. 23 is a flowchart illustrating a recovery process routine.

Hereinafter, the recovery process will be described with reference to FIG. 23. The recovery process also serves as a process of confirming that there is no foreign matter on the scanning path of the carriage 24 and resetting the origin position of the carriage 24. Therefore, the recovery process is executed not only at the time of the recovery operation but also at the time of normal power-on. At the time of recovery process, the abnormality flag F may be "0" or "1".

First, in step S41, the control section 100 determines whether or not abnormality flag F=1 is satisfied. When abnormality flag F=1 is not satisfied, the process proceeds to step S42, and when the abnormality flag F=1, the process proceeds to step S44.

In step S42, the control section 100 sets the first limit value Ilim1.

In step S43, the control section 100 drives the transport motor 46 to be rotated forwardly to unlock the carriage 24. In other words, the control section 100 moves the lock member 68 from the lock position to the unlock position by driving the transport motor 46 to be rotated forwardly. As a result, the lock member 68 moves to the unlock position illustrated by the two-dot chain line in FIG. 14, and the carriage 24 is unlocked.

In step S44, the control section 100 sets the second limit value Ilim2 In other words, at the time of the recovery operation after the transport motor 46 is stopped in an emergency, the second limit value Ilim2 is set as the limit value of the current of the transport motor 46.

In step S45, the control section 100 drives the transport motor 46 to be rotated forwardly to unlock the carriage 24. In other words, the control section 100 moves the lock member 68 from the lock position to the unlock position by driving the transport motor 46 to be rotated forwardly. Incidentally, there is a case where the user operates the OK button or the power supply operation section 16 without removing the jammed medium M, or with a part of the jammed medium M remaining even after the removal is performed. When the emergency stop of the transport motor 46 due to jam detection occurs in the feeding period ST, the transport motor 46 is driven to be rotated forwardly under the state where the first switching section 90 is at the second switching position SW2. In this case, when at least a part of the jammed medium M remains on the transport path, the torque of the transport motor 46 becomes excessive due to the excessive load. However, when abnormality flag F=1 is satisfied, the limit value of the current is set to the second limit value Ilim2, and thus, when the current value of the transport motor 46 exceeds the second limit value Ilim2, the transport motor 46 is stopped in an emergency. As a result, damage or the like to gears that configure the first feeding mechanism 70 is suppressed during the recovery process. The control section 100 monitors the current value of the transport motor 46 in the process of the carriage unlock operation, and detects the presence or absence of the jammed medium M on the transport path.

In step S46, the control section 100 sets the first limit value Ilim1.

In step S47, the control section 100 reciprocates the carriage 24. The control section 100 drives the carriage motor 32 to reciprocate the carriage 24. The control section 100 monitors whether or not the current value of the carriage motor 32 exceeds the threshold value in the process of reciprocating the carriage 24. When the current value of the carriage motor 32 exceeds the limit value in the process of reciprocating the carriage 24, the carriage motor 32 is stopped in an emergency.

In step S48, the control section 100 determines whether or not there is an abnormality. In other words, the control section 100 determines whether or not the current value of the carriage motor 32 exceeds the threshold value. The control section 100 proceeds to step S49 when there is an abnormality, and proceeds to step S50 when there is no abnormality.

In step S49, the control section 100 causes the display section 15A to display a message prompting the recovery operation.

In step S50, the control section 100 drives the transport motor 46 to be rotated reversely to lock the carriage 24. In other words, the control section 100 moves the lock member 68 from the unlock position to the lock position by driving the transport motor 46 to be rotated reversely. When the recovery process is ended without any abnormality in this manner, the recording apparatus 11 stands by until the recorded data PD is received. When abnormality flag F=0 is satisfied, the power is normally turned on, and thus, other initialization operations are continuously performed.

According to the above-described embodiment, the following effects can be obtained.

(1) The medium transport device 200 includes: the pickup roller 211 that feeds the recording medium M; the transport driving roller 43 that transports the recording medium M toward the recording head 25; and the transport motor 46 which is a driving source for the pickup roller 211 and/or the transport driving roller 43. Furthermore, the medium transport device 200 includes: the first feeding mechanism 70 which is the power transmission mechanism that transmits the power of the transport motor 46 to the pickup roller 211; and the control section 100 that controls the current of the transport motor 46. The control section 100 measures the current value while driving the transport motor 46 as the measured current value Imea, and adds the predetermined offset value Iof to the measured current value Imea to set the limit value Ilim2 of the current supplied to the transport motor 46. According to this configuration, the appropriate limit value Ilim2 can be set according to the load of the transport motor 46 at that time. Therefore, when the transport driving roller 43 and the pickup roller 211 are driven by the power of the transport motor 46, it is possible to suppress tooth chipping or the like of gears that configure the first feeding mechanism 70, and it is possible to set the appropriate limit value Ilim2 according to the load at that time which changes over time from the initial stage of use start of the recording apparatus 11 to the end of the service life. Accordingly, even when the load applied to the transport motor 46 changes over time due to the use of the medium transport device 200, it is possible to effectively suppress occurrence of problems such as damage to components such as gears that configure the first feeding mechanism 70.

(2) The medium transport device 200 includes: the pickup roller 211 that feeds the recording medium M; the transport driving roller 43 that transports the recording medium M toward the recording head 25; the movable member other than the transport driving roller 43; and the transport motor 46. Furthermore, the medium transport device 200 includes: the first feeding mechanism 70 which is the power transmission mechanism that transmits the power of the transport motor 46 to the movable member; and the control section 100 that controls the current of the transport motor 46. The control section 100 measures the current value while driving the transport motor 46 as the measured current value Imea, and adds the predetermined offset value Iof to the measured current value Imea to set the limit value Ilim2 of the current supplied to the transport motor 46. According to this configuration, the appropriate limit value Ilim2 can be set according to the load of the transport motor 46 at that time. Therefore, when the transport driving roller 43 and the movable member are driven by the power of the transport motor 46, it is possible to suppress tooth chipping of gears that configure the first feeding mechanism 70, and it is possible to set the appropriate limit value Ilim2 according to the load at that time which changes over time from the initial stage of use start of the recording apparatus 11 to the end of the service life. Accordingly, even when the load applied to the transport motor 46 changes over time due to the use of the medium transport device 200, it is possible to effectively suppress occurrence of problems such as damage to components such as gears that configure the first feeding mechanism 70.

(3) The movable member is the pickup roller 211. The transport motor 46 is a common driving source for the pickup roller 211 and the transport driving roller 43. According to this configuration, the number of components of the transport motor 46 can be reduced.

(4) The control section 100 sets the limit value Ilim2 for the period during which the first feeding mechanism 70, which is the power transmission mechanism, is most loaded, and in this period, the limit value of the current is set to the second limit value Ilim2 smaller than the first limit value Ilim1 set for the period other than this period. Accordingly, it is possible to suppress damage to gears and the like that configure the first feeding mechanism 70 when driving the movable member. When the movable member is not driven, the torque required for a predetermined operation such as a transport operation can be ensured.

(5) The movable member is the pickup roller 211. The maximum value of the gear ratio of the gear train used to drive the pickup roller 211 is larger than the maximum value of the gear ratio of the gear train used to drive the transport driving roller 43. The period set for the second limit value Ilim2 is a period including the maximum speed range of the pickup roller 211 in the feeding period ST during which the pickup roller 211 is driven. Accordingly, it is possible to suppress occurrence of problems such as damage to components such as gears that configure the first feeding mechanism 70, which is a power transmission mechanism, in the feeding period ST during which the medium M is fed.

(6) The medium transport device 200 includes: the first power transmission mechanism that transmits the rotational power of the transport driving roller 43 that is rotated by the power of the transport motor 46; the first feeding mechanism 70, which is the second power transmission mechanism, that transmits the rotational power of the gear group 50, which is the first power transmission mechanism, to the movable member; and the first switching section 90 that switches the gear group 50 which is the first power transmission mechanism and the first feeding mechanism 70 which is the second power transmission mechanism between the coupled state and the decoupled state. The control section 100 is set to the second limit value Ilim2 smaller than the first limit value Ilim1 of the transport period FT in which the movable member is not driven in at least a part of the period during which the movable member is driven according to the switching state by the first switching section 90. According to this configuration, in at least a part of the period during which the movable member is driven, the current of the transport motor 46 is limited to the second limit value Ilim2 smaller than the first limit value Ilim1 set for the period during which the movable member is not driven. Accordingly, it is possible to suppress occurrence of problems such as damage to the components such as gears that configure the first feeding mechanism 70 when driving the movable member. When the movable member is the pickup roller 211, the first power transmission mechanism is the gear group 50, and the second power transmission mechanism is the first feeding mechanism 70. When the movable member is the lock member 68, the first power transmission mechanism is the gear group 50, and the second power transmission mechanism is the maintenance mechanism 65.

(7) The movable member is the pickup roller 211. The control section 100 sets the second limit value Ilim2 smaller than the first limit value Ilim1 set for the transport period FT in which the transport driving roller 43 transports the recording medium M, as the limit value of the current, in the feeding period ST during which the pickup roller 211 is driven. By switching the first switching section 90 from the coupled state to the decoupled state, when the feeding period ST is switched to the transport period FT, the limit value of the current is changed from the second limit value Ilim2 to the first limit value Ilim1 According to this configuration, when the feeding period ST is switched to the transport period FT, the second limit value Ilim2 is changed to the first limit value Ilim1, and thus, it is possible to ensure a large torque required for transporting the medium M in the transport period FT while suppressing occurrence of problems such as tooth chipping of the gears in the feeding period ST. For example, it is possible to suppress variations at the transport position of the medium M due to insufficient torque of the transport motor 46.

(8) The movable member is the lock member 68 that moves between the lock position at which the carriage 24 provided in the recording head 25 is locked to the standby position and the unlock position at which the carriage 24 is unlocked to be movable from the standby position. According to this configuration, it is possible to suppress occurrence of problems such as damage to the components such as gears that configure the first feeding mechanism 70 when driving the lock member 68.

(9) The operation section is provided such as the power supply operation section 16 or the OK button that is operated when performing the jam recovery operation on the recording medium M. The first switching section 90 is configured to be switched by moving the carriage 24 on which the recording head 25 is provided to a predetermined switching position on the scanning path that moves in the scanning direction X, which is the direction intersecting the transport direction Y0 of the recording medium M. The movable member is the lock member 68 that moves between the lock position at which the carriage 24 is locked to the standby position and the unlock position at which the carriage 24 is unlocked to be movable from the standby position. The lock member 68 moves from the lock position to the unlock position when the transport motor 46 is driven to be rotated forwardly in the rotational direction in which the recording medium M is transported. When the control section 100 detects a jam of the medium, the carriage 24 is moved to the standby position to make the carriage 24 stand by, the lock member 68 is moved from the unlock position to the lock position, and then, when receiving the recovery operation by the operation section, after setting the second limit value Ilim2, the transport motor 46 is driven to be rotated forwardly, and the lock member 68 is moved from the lock position to the unlock position.

According to this configuration, when a jam occurs and the driving of the transport motor 46 is stopped, the carriage 24 is moved to the standby position, and the carriage 24 is held at the standby position by the lock member 68 that is moved to the lock position. After this, the user who performed the recovery work such as removing the jammed medium performs the recovery operation on the recording apparatus 11. The control section 100 that received the recovery operation sets the limit value to the second limit value Ilim2, and then, the transport motor 46 is driven to be rotated forwardly. Therefore, even when the transport motor 46 is driven to be rotated forwardly in the same rotational direction as during feeding without removing the jammed recording medium M, the current value supplied to the transport motor 46 is limited to the second limit value Ilim2, and thus, the load applied to the gears that configure the first feeding mechanism 70 is suppressed. Accordingly, it is possible to suppress occurrence of problems such as damage to the components such as gears that configure the first feeding mechanism 70 when performing the recovery operation after occurrence of a jam.

(10) When the carriage 24 is unlocked, the control section 100 changes the limit value from the second limit value Ilim2 to the first limit value Ilim1 According to this configuration, when the lock is released, the transport motor 46 is driven in the direction of transporting the recording medium M, but by setting the limit value Ilim2 that limits the current of the transport motor 46, even when the jammed recording medium M remains, it is possible to suppress occurrence of problems such as tooth chipping of gears. Moreover, after the lock is released, the limit value of the transport motor 46 is changed from the second limit value Ilim2 to the first limit value Ilim1. For example, after this, in the locking process in which the lock member 68 moves from the unlock position to the lock position, a larger torque can be ensured than that in the unlocking process. For example, the carriage 24 can be locked more reliably.

(11) The recording apparatus 11 includes the medium transport device 200 and the recording head 25 for performing recording on the recording medium M. According to this configuration, since the recording apparatus 11 includes the medium transport device 200, the same operation effects as those of the medium transport device 200 can be obtained.

(11) The control method of the medium transport device 200 includes: measuring the current value while driving the transport motor 46 as the measured current value Imea by the control section 100; and setting the limit value Ilim2 of the current supplied to the transport motor 46 by adding the predetermined offset value Iof to the measured current value Imea by the control section 100. According to the control method, even when the load applied to the transport motor 46 changes over time due to the use of the medium transport device 200, it is possible to effectively suppress occurrence of problems such as damage to components such as gears that configure the first feeding mechanism 70.

The above-described embodiment can also be changed to a form such as the modification example illustrated below. Furthermore, a further modification example may also be an appropriate combination of the above-described embodiment and the modification examples illustrated below, or an appropriate combination of the modification examples illustrated below may be a further modification example.

Figure 24:
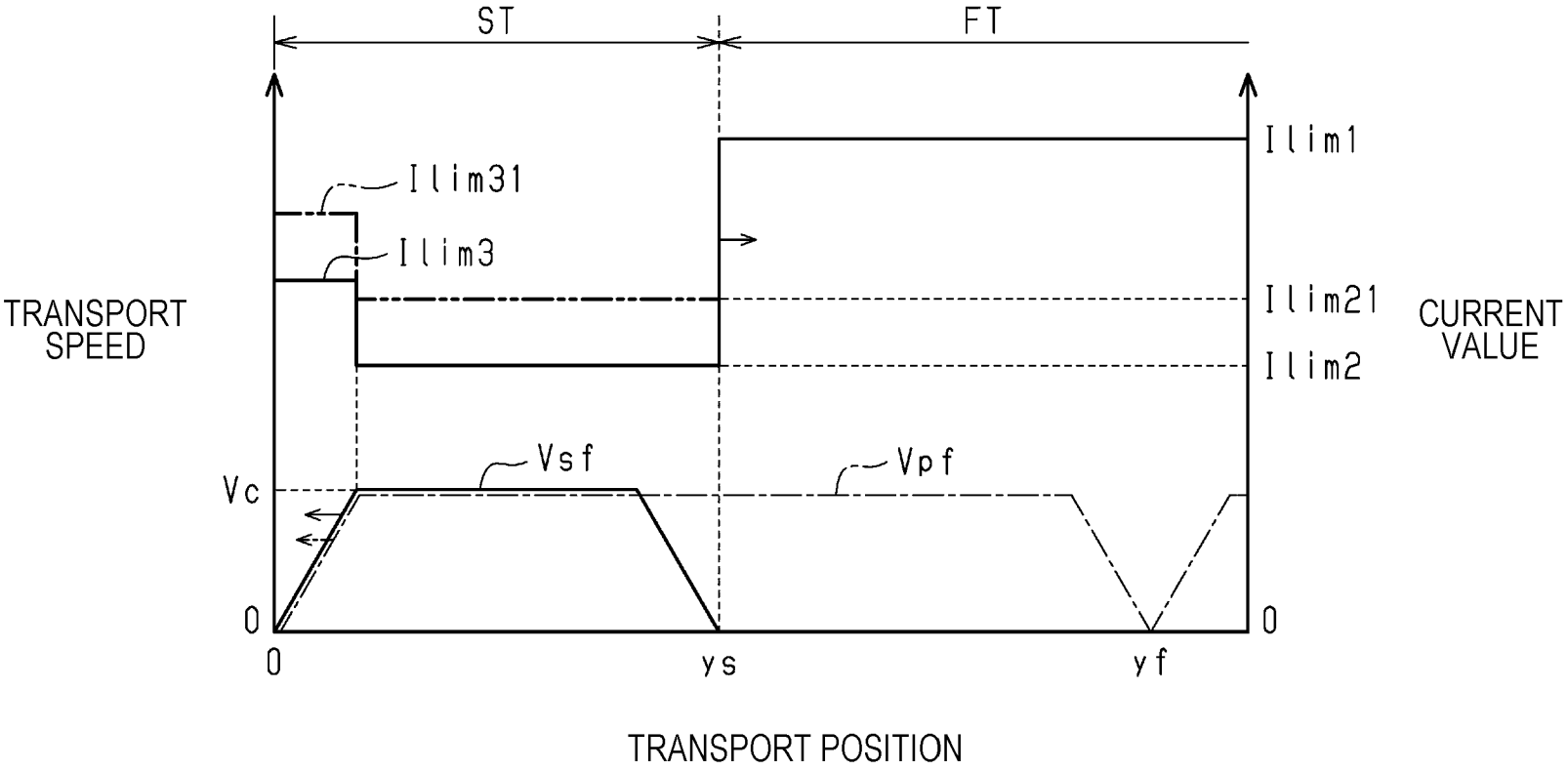
FIG. 24 is a graph illustrating the limit value set for a feeding period and a transport period in a modification example.

As illustrated in FIG. 24, in the feeding period, the second limit value Ilim2 may be set in the constant speed range and the deceleration range, and a limit value Ilim3 larger than the limit value Ilim2 may be set as the second limit value in the acceleration range. In other words, a plurality of stages of values may be set as the second limit value in the driving period of the movable member. In the example of FIG. 24, the acceleration range is set to the second limit value Ilim3 smaller than the first limit value Ilim1, but the second limit value Ilim3 is set to a value larger than the second limit value Ilim2 in the constant speed range (Ilim2<Ilim3<Ilim1) According to this configuration, it is possible to ensure the torque required in the acceleration range while suppressing tooth chipping in the feeding period. In the period during which the service life of the recording apparatus 11 ends, as illustrated by the two-dot chain line in FIG. 24, the second limit value Ilim21 larger than the second limit value Ilim2 in the initial stage is set according to the measured current value. Accordingly, the appropriate second limit value Ilim2 can be set from the initial use of the recording apparatus 11 to the end of the service life.

In FIG. 24, the first limit value Ilim1 may be set in the acceleration range.

In FIGS. 19, 20, and 24, the first limit value Ilim1 may be set in the deceleration range of the feeding period.

The feeding period may be a period until the medium M fed from the cassette 27 by the pickup roller 211 is nipped by the transport roller pair 41, or a part of the period including the constant speed range in this period. Even in such a feeding period, by setting the second limit value Ilim2, it is possible to suppress damage to components such as gears that configure the first feeding mechanism 70.

The movable member may be the pump 63 of the maintenance device 60. The medium transport device 200 includes: the cap 61 that forms the closed space surrounding the nozzle by coming into contact with the nozzle surface on which the nozzle of the recording head 25 is open; and the maintenance device 60 having the pump 63 that suctions air in the closed space to make a negative pressure in the closed space. The movable member may be the pump 63. According to this configuration, damage to gears and the like that configure the maintenance mechanism 65, which is the power transmission mechanism of the maintenance device 60, can be suppressed. The maintenance device 60 includes the maintenance mechanism 65 as an example of the power transmission mechanism that transmits the power of the motor to the pump 63. The limit value that limits the current flowing through the motor may be set to the second limit value Ilim2 set in at least the constant speed range in the pump driving period to be a smaller value, rather than the first limit value Ilim1 set in the transport period FT. The current value measurement of the motor may be performed without switching the first switching section 90 and without driving the pump 63, or may perform air suction of the pump 63 by switching the first switching section 90. Here, the air suction is an operation of driving the pump 63 in a state where the cap 61 and the nozzle surface of the recording head 25 are separated from each other. In the latter case, the pump 63 is driven during the current value measurement such that the liquid such as ink is not wasted from the nozzle of the recording head 25, the obtained measured current value is added to the load of the pump 63 and the maintenance mechanism 65, and thus, the second limit value Ilim2 with higher accuracy can be set. The pump 63 may be driven during the forward rotation driving of the transport motor 46, or may be driven during the reverse rotation driving. The control section 100 sets the second limit value Ilim2 for performing maintenance, and sets the second limit value Ilim2 smaller than the first limit value Ilim1 in at least a part of the pump driving period.

The medium transport device 200 includes the maintenance device 60 having the cap 61 and the pump 63. The movable member may be the pump 63. The control section 100 drives the pump 63 by driving the transport motor 46 to be rotated forwardly in the rotational direction in which the recording medium M is transported, and accordingly, maintenance is performed to forcibly suction and discharge the liquid from the nozzle with the negative pressure made in the closed space. When measuring the measured current value Imea of the transport motor 46, air suction is performed to drive the pump 63 without bringing the cap 61 into contact with the nozzle surface. According to this configuration, the measurement of the measured current value Imea of the transport motor 46 is performed at the time of air suction. In other words, the measured current value Imea includes a load of the transport system including the transport driving roller 43 and a load of the maintenance system for driving the pump 63. Accordingly, it is possible to acquire a more accurate measured current value Imea including the load of the maintenance system. For example, it is possible to measure only the load of the transport system, use the load of the maintenance system as an estimated value, and add the offset value Iof including this estimated value to set the limit value Ilim2. In this case, the accuracy is reduced by the amount including the estimated value. Compared to this, the load of the maintenance mechanism 65, which is the power transmission mechanism of the maintenance device 60, can also be measured, and thus, the limit value Ilim2 can be set with higher accuracy according to the load. Accordingly, damage to the gears and the like that configure the maintenance mechanism 65, which is the power transmission mechanism of the maintenance device 60, can be suppressed.

The plurality of mounting sections (feeding tray 22A, cassette 27) on which the recording medium M can be mounted; the plurality of feeding rollers (pickup roller 211, feeding roller 221) for feeding the recording media M mounted on the plurality of mounting sections, respectively; and the plurality of feeding mechanisms (first feeding mechanism 70, second feeding mechanism 80) for transmitting the power of the transport motor 46 to the plurality of feeding rollers, are provided. The control section 100 may set the second limit value Ilim2 to be different for the plurality of feeding periods in which the plurality of feeding rollers are driven. According to this configuration, the plurality of feeding rollers rotated by the power transmitted by the plurality of feeding mechanisms transport the recording medium to the transport driving roller 43 through feeding paths different from each other. The plurality of feeding mechanisms differ in their respective configurations, the length of the feeding path, the shape of the feeding path, the degree of wear of the configuration components of the feeding mechanism, and the like. Therefore, the load of the transport motor 46 differs depending on which of the plurality of feeding mechanisms is selected to feed the medium. Since the control section 100 sets the second limit value to be different for each feeding period during which the plurality of feeding rollers are driven, even when the load is different for each of the plurality of feeding mechanisms, it is possible to suppress damage to components such as gears that configure the feeding mechanism at the time of occurrence of abnormality such as a jam, and additionally, it is possible to ensure the torque required for feeding by the feeding roller. The plurality of cassettes 27 may be provided as the mounting section.

The control section 100 acquires medium type information, which is information on the type of the recording medium M fed by the pickup roller 211. The second limit value to be different according to the medium type information may be set. According to this configuration, the load applied to the transport motor 46 differs when the recording medium is fed by the pickup roller 211 depending on the type of the recording medium. The control section 100 acquires medium type information, which is information on the type of the recording medium M fed by the pickup roller 211. The second limit value to be different according to the medium type information is set. Accordingly, an appropriate limit value can be set regardless of the type of recording medium. Therefore, damage to the gears and the like that configure the first feeding mechanism 70, which is the power transmission mechanism for transmitting power to the pickup roller 211, can be more appropriately suppressed.

The movable member may be the recording head 25 provided so as to be movable in the vertical direction in a gap adjustment mechanism that adjusts the gap between the recording head 25 and the medium support member 35 according to the medium type. In the gap adjustment mechanism, the height position of the carriage 24 with respect to the guide shaft is changed by rotating the guide shaft by the power of the transport motor 46 via a cam mechanism fixed to both end portions of the guide shaft supporting the carriage 24. Accordingly, the height position of the recording head 25 is changed, and thus, the gap between the recording head 25 and the medium support member 35 is adjusted. According to this configuration, it is possible to suppress damage or the like to the gears in the gap adjustment period during which the height position of the recording head 25 is adjusted.

When there are a plurality of movable members having a motor as a common driving source, each second limit value set for each driving period of the plurality of movable members may be different. For example, the value of the second limit value set in each driving period of the feeding roller and the lock member 68 may be different. The value of the second limit value set in each driving period of the feeding roller and the pump may be different. Furthermore, the value of the second limit value set in each driving period of the feeding roller and the recording head 25 in the gap adjustment mechanism may be different.

The feeding section 20 and the transport section 40 may be driven by different motors. In other words, the recording apparatus 11 includes a feeding motor as a driving source for the feeding section 20 and a transport motor as a driving source for the transport section 40. At the time of the load measurement of the feeding motor, when the feeding motor is driven, the medium mounted on the feeding tray 22A or the cassette 27 is fed and transported. Therefore, it is preferable to operate the operation section to set the recording apparatus 11 to be in the measurement mode when the user desires the measurement. Since the medium is fed for the load measurement of the motor, the load of the motor including the actual load of the feeding mechanism can be measured. Therefore, by adding the offset value to this measured current value, it is possible to set a highly accurate limit value.

In the above-described embodiment, the pickup roller 211 and the lock member 68, which are examples of the feeding rollers, are used as movable members, but the movable member may be only the pickup roller 211 or only the lock member 68. In the former case, damage or the like to the gears in the feeding period can be suppressed by setting the second limit value based on the measured current value in at least a part of the feeding period. In the latter case, damage or the like to the gears in the driving period of the lock member 68 can be suppressed by setting the second limit value based on the measured current value in at least a part of the driving period of the lock member 68.

The motor is not limited to a configuration which is a common driving source for the feeding roller and the transport roller. It may be configured to include a plurality of motors that individually drive the feeding roller and the transport roller.

Movable members other than the transport roller of which the driving source is a motor are not limited to the pickup roller 211 and the lock member 68. For example, the movable members include the cap 61, the wiper 62, the pump 63, the recording head 25 in a gap adjusting device, the discharge tray in an automatically driven type discharge tray mechanism, the discharge cover 26 in an automatic cover opening and closing mechanism, the operation panel 15 in an operation panel angle adjustment mechanism. In these cases, the power transmission mechanism including the gears is, in order, a cap raising and lowering mechanism, a wiper wiping mechanism, a pump mechanism, a gap adjustment mechanism, a tray driving mechanism, a cover opening and closing mechanism, and a panel driving mechanism. For example, the gap adjustment mechanism is a mechanism for adjusting the gap between the nozzle surface on which the nozzle of the recording head 25 opens and the support surface 35A of the medium support member 35. The automatically driven type discharge tray mechanism is a mechanism that automatically moves the discharge tray in and out by the power of the motor. The automatic cover opening and closing mechanism is a mechanism for opening and closing the cover by rotating or sliding, the cover in a closed state for covering the discharge tray housed in the apparatus main body 12 and an open state for exposing the discharge tray. The operation panel angle adjustment mechanism is a mechanism that automatically adjusts the posture angle of the operation panel 15. For example, the control section 100 adjusts the operation panel to an appropriate posture angle when the power is turned on, and adjusts the operation panel to the posture angle when being housed when the power is cut off. According to these configurations, the second limit value Ilim2 is set in the period during which the movable member is driven, and accordingly, even when the load applied to the motor changes over time due to the use of the medium transport device, an appropriate limit value is set, and it is possible to effectively suppress occurrence of problems such as tooth chipping of the gears that configure the power transmission mechanism.

A medium transport device provided with a dedicated feeding motor for driving the feeding section 20 may be used. In other words, the feeding motor, which is the driving source of the feeding roller, and the transport motor 46, which is the driving source of the transport roller, may be separately provided. In this case, the feeding motor may be a common driving source for other movable members other than the transport roller. Then, the control section 100 may drive the feeding motor by controlling the current, and may measure the current value flowing through the feeding motor while being driven as the measured current value Imea. In this case, the control section 100 may set the limit value of the current supplied to the feeding motor by adding the predetermined offset value Iof to the measured current value Imea. As other movable members, those listed in the previous section are applied.

In a configuration including the feeding motor, the motor which is a target of setting the limit value may be the feeding motor instead of the transport motor 46.

The user may select and operate the measurement mode to shift to the load measurement mode in which the load of the motor is measured. In this case, the switching section may be switched to the coupled state to drive the feeding roller (for example, the pickup roller 211) which is an example of the movable member. In this case, only the medium M is fed and transported without recording on the medium M, and the medium M after measuring the current value of the motor is discharged to the discharge tray. In this current value measurement, the pickup roller 211 is driven, and thus, the load in the feeding period can be measured more accurately. Accordingly, a more accurate limit value (for example, the second limit value Ilim2) can be set.

The first limit value Ilim1, which is a limit value set in the transport period during which the transport roller is driven, may be obtained by adding the predetermined offset value Iof to the measured current value Imea. In this case, the limit value may be configured such that the first limit value Ilim1 and the second limit value Ilim2 are set, or only one corresponding to the first limit value Ilim1 is set. According to this configuration, it is possible to suppress occurrence of problems such as damage or the like to the components that configure the power transmission mechanism in the transport period during which the transport roller is driven.

The second limit value Ilim2 may be set to a value larger than the first limit value Ilim1 In this case, it is possible to suppress the tooth chipping of the gears in the period during which the movable member is driven. For example, in contrast to a configuration in which the limit value is uniformly set to a low fixed value in order to suppress damage or the like to the gears that configure the power transmission mechanism 47 that transmits the power of the transport motor 46 to the transport roller, the second limit value Ilim2 can be set to a variable value based on the measured current value of the motor. Accordingly, it is possible to ensure the necessary torque in the period during which the movable member is driven while suppressing damage or the like to the gears in the transport period during which the transport roller is driven. It is preferable that the transport roller is not driven by the switching section in the driving period of the movable member, but even when the transport roller is driven, the first limit value smaller than the second limit value is set at least in the transport period, and thus, damage or the like to the gears is unlikely to occur.

The time to enter the load measurement mode is not limited to the time when the power of the recording apparatus 11 is turned on, but instead of the time when the power is turned on, the time when the power is turned on may be added, and the time before entering the power saving mode may also be the time. The current value measurement (load measurement) of the motor may be performed each time the power is turned on. Furthermore, the current value measurement of the motor may be performed when the power is cut off. Furthermore, when the recording medium M, which is the recording target, is fed, the load measurement mode is entered, and the limit value of the current of the transport motor 46 may be set based on the measured current value Imea measured in the feeding period of the recording medium M, which is the recording target. In this case, although the limit value based on the measured current value Imea cannot be set only at the time of recording the first sheet in which the recording apparatus 11 is used for the first time, the limit value based on the measured current value Imea can be set at the time of recording the second and subsequent sheets. According to this configuration, the measured current value Imea can be acquired under the state where the feeding roller is driven, and thus, a more accurate limit value can be set based on the measured current value Imea.

The second feeding section 22 may have a configuration in which the user has a manual insertion tray as an example of the mounting section on which a special paper sheet such as photo paper is mounted, instead of the automatic feeding section having a hopper.

The transport section 40 may use a belt transport method instead of the roller transport method.

The recording apparatus 11 is not limited to a serial printer in which the recording section 23 reciprocates in the scanning direction X, and may be a lateral type printer in which the recording section 23 can move in two directions, such as a main scanning direction and a sub-scanning direction. Furthermore, the recording apparatus 11 may be a line printer.

The recording apparatus 11 may be a multifunction device with a reading unit mounted thereon. In this case, the medium transport device may be provided in a reading apparatus that reads a document as an example of the recording medium. The medium transport device may be provided in the reading apparatus such as a read-only scanner including a sheet feed type reading section. In this manner, the medium transport device of the reading apparatus includes: the feeding roller that feeds a document which is an example of the recording medium; the transport roller that transports the document toward the reading section; and the transport motor which is an individual or common driving source for the feeding roller and the transport roller. The reading apparatus includes the medium transport device and the reading section that reads an image of a document. Even in such a reading apparatus, damage to components such as gears that configure the power transmission mechanism can be suppressed by setting the limit value obtained by adding the offset value to the measured current value of the transport motor.

The medium M is not limited to a paper sheet, but may be a flexible plastic film, a cloth, a non-woven fabric, or the like, or may be a laminate.

The recording apparatus 11 is not limited to a printer that performs recording on a medium such as a paper sheet, and may be a textile printing machine that performs printing on cloth.

The recording apparatus 11 is not limited to the ink jet method, and may be a wire impact type recording apparatus or a thermal transfer type recording apparatus.

The recording apparatus is not limited to the printer for printing. For example, the recording apparatus may be an apparatus that manufacture pixels of various types of displays, such as electric wiring pattern, liquid crystal, electroluminescence (EL), surface emission, or the like, on a substrate which is an example of the medium by discharging a liquid material in which particles of a functional material are dispersed or mixed in a liquid.

In the present specification, the rotational direction of the motor when the motor transports the recording medium mounted on the mounting section toward the recording region where the recording head performs recording is set as the forward rotational direction, and the rotation of the motor in the forward rotational direction is called forward rotation. The rotation in the direction opposite to the forward rotational direction of the motor is called reverse rotation, and the direction in which the motor is reversely rotated is called reverse rotational direction.

The technical idea grasped from the embodiments and the modification examples is described below together with the operation effects thereof.

(A) A medium transport device that transports a recording medium, includes: a feeding roller that feeds the recording medium; a transport roller that transports the recording medium fed by the feeding roller; a motor which is an individual or common driving source for the feeding roller and the transport roller; a power transmission mechanism that transmits power of the motor to at least one of the feeding roller and the transport roller; and a control section that controls a current of the motor, and the control section measures a current value during driving of the motor as a measured current value, and sets a limit value of a current supplied to the motor by adding a predetermined offset value to the measured current value.

According to this configuration, the appropriate limit value can be set according to the load of the motor at that time. Therefore, when the feeding roller or the transport roller is driven by the power of the motor, it is possible to suppress damage or the like to components such as gears that configure the power transmission mechanism, and it is possible to set the appropriate limit value according to the load at that time, which changes over time from the initial stage of use start of the recording apparatus to the end of the service life thereof. Accordingly, even when the load applied to the motor changes over time due to the use of the medium transport device, it is possible to effectively suppress occurrence of problems such as damage to components such as gears that configure the power transmission mechanism.

(B) A medium transport device that transports a recording medium, includes: a feeding roller that feeds the recording medium; a transport roller that transports the recording medium fed by the feeding roller; a movable member other than the transport roller; a motor; a power transmission mechanism that transmits power of the motor to the movable member; and a control section that controls a current of the motor, and the control section measures a current value during driving of the motor as a measured current value, and sets a limit value of a current supplied to the motor by adding a predetermined offset value to the measured current value.

According to this configuration, the appropriate limit value can be set according to the load of the motor at that time. Therefore, when the movable member is driven by the power of the motor, it is possible to suppress damage to components such as gears that configure the power transmission mechanism, and it is possible to set the appropriate limit value according to the load at that time, which changes over time from the initial stage of use start of the recording apparatus to the end of the service life thereof. Accordingly, even when the load applied to the motor changes over time due to the use of the medium transport device, it is possible to effectively suppress occurrence of problems such as damage to components such as gears that configure the power transmission mechanism.

(C) In the above-described medium transport device, the movable member may be the feeding roller, and the motor may be a common driving source for the feeding roller and the transport roller. According to this configuration, the number of components of the motor can be reduced.

(D) In the above-described medium transport device, the control section may set the limit value of the current for a period during which a load applied to the power transmission mechanism is largest, and in the period, the limit value of the current is set to a second limit value smaller than a preset first limit value for a period other than the period.

According to this configuration, in the period when the gears that configure the power transmission mechanism are most loaded, the limit value of the current is set to the second limit value smaller than the first limit value set for the period other than the period. Accordingly, it is possible to suppress occurrence of problems such as damage to the components such as gears that configure the power transmission mechanism when driving the movable member.

(E) In the above-described medium transport device, the movable member may be the feeding roller, and the period during which the limit value of the current is set to the second limit value may be a period including a maximum speed range of the feeding roller in a feeding period during which the feeding roller is driven.

According to this configuration, it is possible to suppress occurrence of problems such as damage to components such as gears that configure the power transmission mechanism in the feeding period during which the medium is fed.

(F) In the above-described medium transport device, there may further be provided a first power transmission mechanism that transmits rotational power of the transport roller rotated by the power of the motor; a second power transmission mechanism that transmits rotational power of the first power transmission mechanism to the movable member; and a switching section for switching the first power transmission mechanism and the second power transmission mechanism between a coupled state and a decoupled state, and the control section may set a second limit value smaller than a first limit value set for a period during which the movable member is not driven, as the limit value of the current, in at least a part of a period during which the movable member is driven, according to a switching state by the switching section.

According to this configuration, in at least a part of the period during which the movable member is driven, the current of the motor is limited to the second limit value smaller than the first limit value when the movable member is not driven. Accordingly, it is possible to suppress occurrence of problems such as damage to the components such as gears that configure the power transmission mechanism when driving the movable member.

(G) In the above-described medium transport device, the movable member may be the feeding roller, the control section may set a second limit value smaller than a first limit value set for a transport period during which the transport roller transports the recording medium, as the limit value of the current, in a feeding period during which the feeding roller is driven, and the limit value of the current may be changed from the second limit value to the first limit value when switching from the feeding period to the transport period by switching the switching section from the coupled state to the decoupled state.

According to this configuration, when the feeding period is switched to the transport period, the second limit value is changed to the first limit value, and thus, it is possible to ensure a large torque required for transporting the medium in the transport period while suppressing occurrence of problems such as tooth chipping of gears in the feeding period. For example, it is possible to suppress variations at the transport position of the medium due to insufficient torque of the motor.

(H) In the above-described medium transport device, there may further be provided a lock member that moves between a lock position at which a carriage provided with a recording head for performing recording on the recording medium is locked at a standby position and an unlock position at which the carriage is unlocked to be movable from the standby position, and the movable member may be the lock member.

According to this configuration, it is possible to suppress occurrence of problems such as damage to the components such as gears that configure the power transmission mechanism when driving the lock member.

(I) In the above-described medium transport device, there may further be provided an operation section operated when a jam recovery operation of the recording medium is performed, the switching section may be switched by moving to a predetermined switching position on a scanning path on which a carriage provided with a recording head for performing recording on the recording medium moves in a scanning direction, which is a direction intersecting a transport direction of the recording medium, the movable member may be a lock member that moves between a lock position at which the carriage is locked at a standby position and an unlock position at which the carriage is unlocked to be movable from the standby position, the lock member may move from the lock position to the unlock position when the motor is driven to be rotated forwardly in a rotational direction of transporting the recording medium, and when a jam of the medium is detected, the control section may move the carriage to the standby position and make the carriage stand by, and move the lock member from the unlock position to the lock position, and then, when a recovery operation by the operation section is received, the control section may drive the motor to be rotated forwardly and move the lock member from the lock position to the unlock position, after setting the second limit value.

According to this configuration, when a jam occurs and the driving of the motor is stopped, the carriage is moved to the standby position, and the carriage is held at the standby position by the lock member that is moved to the lock position. After this, the user who performed the recovery work such as removing the jammed medium performs the recovery operation on the recording apparatus. The control section that received the recovery operation sets the limit value to the second limit value, and then, the motor is driven to be rotated forwardly. Therefore, even when the motor is driven to be rotated forwardly in the same rotational direction as during feeding without removing the jammed recording medium, the current value supplied to the motor is limited to the second limit value, and thus, the load applied to the gears that configure the power transmission mechanism is suppressed. Accordingly, it is possible to suppress occurrence of problems such as damage to the components such as gears that configure the power transmission mechanism when performing the recovery operation after occurrence of a jam.

(J) In the above-described medium transport device, the control section may change the limit value of the current from the second limit value to the first limit value when the carriage is unlocked.

According to this configuration, when the lock member moves from the lock position to the unlock position, the motor is driven in the direction of transporting the recording medium, but by setting the second limit value that limits the current of the motor, even when the jammed recording medium remains on the transport path, it is possible to suppress occurrence of problems such as tooth chipping of the gear. Moreover, after the lock is released, the limit value of the motor is changed from the second limit value to the first limit value. For example, after this, in the locking process in which the lock member moves from the unlock position to the lock position, a larger torque can be ensured than that in the unlocking process. For example, the carriage can be locked more reliably.

(K) In the above-described medium transport device, there may further be provided a plurality of mounting sections on which the recording medium is mounted; a plurality of the feeding rollers that respectively feed the recording medium mounted on the plurality of mounting sections; and a plurality of feeding mechanisms that transmit the power of the motor to the plurality of the feeding rollers, and the control section may set the second limit value to be different for the plurality of feeding periods in which the plurality of feeding rollers are driven.

According to this configuration, the plurality of feeding rollers rotated by the power transmitted by the plurality of feeding mechanisms transport the recording medium to the transport roller through feeding paths different from each other. The plurality of feeding mechanisms differ in their respective configurations, the length of the feeding path, the shape of the feeding path, the degree of wear of the configuration components of the feeding mechanism, and the like. Therefore, the load of the motor differs depending on which of the plurality of feeding mechanisms is selected to feed the medium. Since the control section sets the second limit value to be different for each feeding period during which the plurality of feeding rollers are driven, even when the load is different for each of the plurality of feeding mechanisms, it is possible to suppress occurrence of problems such as damage to components such as gears that configure the feeding mechanism at the time of occurrence of abnormality such as a jam, and additionally, it is possible to ensure the torque required for feeding by the feeding roller.

(L) In the above-described medium transport device, the control section may acquire medium type information which is information on a type of the recording medium fed by the feeding roller, and set a second limit value to be different according to the medium type information.

According to this configuration, the load applied to the motor differs when the recording medium is fed by the feeding roller depending on the type of the recording medium. The control section acquires the medium type information, which is information on the type of recording medium fed by the feeding roller, and sets the second limit value to be different according to the medium type information. Accordingly, an appropriate limit value can be set regardless of the type of recording medium. Accordingly, it is possible to more appropriately suppress occurrence of problems such as damage to components such as gears that configure the power transmission mechanism that transmits the power to the feeding roller.

(M) In the above-described medium transport device, there may further be provided a maintenance device having a cap that forms a closed space surrounding a nozzle of a recording head for performing recording on the recording medium, by coming into contact with a nozzle surface on which the nozzle is open, and a pump that suctions air in the closed space to make a negative pressure in the closed space, and the movable member may be the pump.

According to this configuration, it is possible to suppress occurrence of problems such as damage to components such as gears that configure the power transmission mechanism of the maintenance device.

(N) In the above-described medium transport device, there may further be provided a maintenance device having a cap that forms a closed space surrounding a nozzle of a recording head for performing recording on the recording medium, by coming into contact with a nozzle surface on which the nozzle is open, and a pump that suctions air in the closed space to make a negative pressure in the closed space, the movable member may be the pump, the control section may perform maintenance for forcibly suctioning and discharging liquid from the nozzle with the negative pressure made in the closed space by driving the motor to be rotated forwardly in a rotational direction in which the recording medium is transported to drive the pump, and air suction may be performed to drive the pump without forming the closed space between the cap and the nozzle surface when measuring the measured current value of the motor.

According to this configuration, the measurement of the measured current value of the motor is performed at the time of air suction. In other words, the measured current value includes a load of the transport system including the transport roller and a load of the maintenance system for driving the pump. Accordingly, it is possible to acquire a more accurate measured current value including the load of the maintenance system. For example, it is possible to measure only the load of the transport system, use the load of the maintenance system as an estimated value, and add the offset value including this estimated value to set the limit value. In this case, the accuracy is reduced by the amount including the estimated value. Compared to this, the load of the power transmission mechanism of the maintenance device, can also be measured, and thus, the limit value can be set with higher accuracy according to the load. Accordingly, it is possible to suppress occurrence of problems such as damage to components such as gears that configure the power transmission mechanism of the maintenance device.

(O) A recording apparatus includes the medium transport device and a recording head that performs recording on the recording medium. According to this configuration, since the recording apparatus includes the medium transport device, the same operation effects as those of the medium transport device can be obtained.

(P) A control method of a medium transport device including a feeding roller that feeds a recording medium, a transport roller that transports the recording medium fed by the feeding roller, a motor which is an individual or common driving source for the feeding roller and the transport roller, a power transmission mechanism that transmits power of the motor to at least one of the feeding roller and the transport roller, and a control section that controls driving of the motor, the method includes: measuring a current value during driving of the motor as a measured current value by the control section; and setting a limit value of a current supplied to the motor by adding a predetermined offset value to the measured current value by the control section.

According to this method, even when the load applied to the motor changes over time due to the use of the medium transport device, it is possible to effectively suppress occurrence of problems such as damage to components such as gears that configure the power transmission mechanism.

(Q) A control method of a medium transport device including a feeding roller that feeds a recording medium, a transport roller that transports the recording medium fed by the feeding roller, a movable member other than the transport roller, a motor, a power transmission mechanism that transmits power of the motor to the movable member, and a control section that controls driving of the motor, the method includes: measuring a current value during driving of the motor as a measured current value by the control section; and setting a limit value of a current supplied to the motor by adding a predetermined offset value to the measured current value by the control section.

According to this method, even when the load applied to the motor changes over time due to the use of the medium transport device, it is possible to effectively suppress occurrence of problems such as damage to components such as gears that configure the power transmission mechanism.

What is claimed is:

1. A medium transport device that transports a recording medium, comprising:

a feeding roller that feeds the recording medium;

a transport roller that transports the recording medium fed by the feed roller;

a motor which is a driving source for the feeding roller and/or the transport roller;

a power transmission mechanism that transmits power of the motor to at least one of the feeding roller and the transport roller; and a control section that controls a current of the motor, wherein the control section measures a current value during driving of the motor as a measured current value, and sets a limit value of a current supplied to the motor by adding a predetermined offset value to the measured current value.

2. The medium transport device according to claim 1, wherein the control section sets the limit value of the current for a period during which a load applied to the power transmission mechanism is largest, and in the period, the limit value of the current is set to a second limit value smaller than a preset first limit value for a period other than the period.

3. The medium transport device according to claim 2, wherein the period during which the limit value of the current is set to the second limit value is a period including a maximum speed range of the feeding roller in a feeding period during which the feeding roller is driven.

4. The medium transport device according to claim 3, further comprising:

a plurality of mounting sections on which the recording medium is mounted;

a plurality of the feeding rollers that respectively feed the recording medium mounted on the plurality of mounting sections; and a plurality of feeding mechanisms that transmit the power of the motor to the plurality of the feeding rollers, wherein the control section sets the second limit value to be different for the plurality of feeding periods in which the plurality of feeding rollers are driven.

5. The medium transport device according to claim 1, wherein the control section acquires medium type information which is information on a type of the recording medium fed by the feeding roller, and sets a second limit value to be different according to the medium type information.

6. A recording apparatus comprising:

the medium transport device according to claim 1; and a recording head for performing recording on the recording medium.

7. A medium transport device that transports a recording medium, comprising:

a feeding roller that feeds the recording medium;

a transport roller that transports the recording medium fed by the feeding roller;

a movable member other than the transport roller;

a motor;

a power transmission mechanism that transmits power of the motor to the movable member; and a control section that controls a current of the motor, wherein the control section measures a current value during driving of the motor as a measured current value, and sets a limit value of a current supplied to the motor by adding a predetermined offset value to the measured current value.

8. The medium transport device according to claim 7, wherein the movable member is the feeding roller, and the motor is a common driving source for the feeding roller and the transport roller.

9. The medium transport device according to claim 7, further comprising:

a first power transmission mechanism that transmits rotational power of the transport roller rotated by the power of the motor;

a second power transmission mechanism that transmits rotational power of the first power transmission mechanism to the movable member; and a switching section for switching the first power transmission mechanism and the second power transmission mechanism between a coupled state and a decoupled state, wherein the control section sets a second limit value smaller than a first limit value set for a period during which the movable member is not driven, as the limit value of the current, in at least a part of a period during which the movable member is driven, according to a switching state by the switching section.

10. The medium transport device according to claim 9, wherein the movable member is the feeding roller, the control section sets a second limit value smaller than a first limit value set for a transport period during which the transport roller transports the recording medium, as the limit value of the current, in a feeding period during which the feeding roller is driven, and the limit value of the current is changed from the second limit value to the first limit value when switching from the feeding period to the transport period by switching the switching section from the coupled state to the decoupled state.

11. The medium transport device according to claim 9, further comprising:

a lock member that moves between a lock position at which a carriage provided with a recording head for performing recording on the recording medium is locked at a standby position and an unlock position at which the carriage is unlocked to be movable from the standby position, wherein the movable member is the lock member.

12. The medium transport device according to claim 11, wherein the control section changes the limit value from the second limit value to the first limit value when the carriage is unlocked.

13. The medium transport device according to claim 9, further comprising:

an operation section operated when a jam recovery operation of the recording medium is performed, wherein the switching section is switched by moving to a predetermined switching position on a scanning path on which a carriage provided with a recording head for performing recording on the recording medium moves in a scanning direction, which is a direction intersecting a transport direction of the recording medium, the movable member is a lock member that moves between a lock position at which the carriage is locked at a standby position and an unlock position at which the carriage is unlocked to be movable from the standby position, the lock member moves from the lock position to the unlock position when the motor is driven to be rotated forwardly in a rotational direction of transporting the recording medium, and when a jam of the medium is detected, the control section moves the carriage to the standby position and makes the carriage stand by, and moves the lock member from the unlock position to the lock position, and then, when a recovery operation by the operation section is received, the control section drives the motor to be rotated forwardly and moves the lock member from the lock position to the unlock position, after setting the second limit value.

14. The medium transport device according to claim 7, further comprising:

a maintenance device having a cap that forms a closed space surrounding a nozzle of a recording head for performing recording on the recording medium, by coming into contact with a nozzle surface on which the nozzle is open, and a pump that suctions air in the closed space to make a negative pressure in the closed space, wherein the movable member is the pump.

15. The medium transport device according to claim 7, further comprising:

a maintenance device having a cap that forms a closed space surrounding a nozzle of a recording head for performing recording on the recording medium, by coming into contact with a nozzle surface on which the nozzle is open, and a pump that suctions air in the closed space to make a negative pressure in the closed space, wherein the movable member is the pump, the control section performs maintenance for forcibly suctioning and discharging liquid from the nozzle with the negative pressure made in the closed space by driving the motor to be rotated forwardly in a rotational direction in which the recording medium is transported to drive the pump, and air suction is performed to drive the pump without forming the closed space between the cap and the nozzle surface when measuring the measured current value of the motor.

16. A control method of a medium transport device including a feeding roller that feeds a recording medium, a transport roller that transports the recording medium fed by the feeding roller, a motor which is an individual or common driving source for the feeding roller and the transport roller, a power transmission mechanism that transmits power of the motor to at least one of the feeding roller and the transport roller, and a control section that controls driving of the motor, the method comprising:

measuring a current value during driving of the motor as a measured current value by the control section; and setting a limit value of a current supplied to the motor by adding a predetermined offset value to the measured current value by the control section.

17. A control method of a medium transport device including a feeding roller that feeds a recording medium, a transport roller that transports the recording medium fed by the feeding roller, a movable member other than the transport roller, a motor, a power transmission mechanism that transmits power of the motor to the movable member, and a control section that controls driving of the motor, the method comprising:

measuring a current value during driving of the motor as a measured current value by the control section; and setting a limit value of a current supplied to the motor by adding a predetermined offset value to the measured current value by the control section.

* * * * *